US009410329B2

(12) United States Patent
Keersmaekers

(10) Patent No.: US 9,410,329 B2
(45) Date of Patent: Aug. 9, 2016

(54) LIFT UNIT FOR ASCENDING AND DESCENDING A SCAFFOLD

(76) Inventor: Marc Keersmaekers, Dessel (BE)

( * ) Notice: Subject to any disclaimer, the term of this patent is extended or adjusted under 35 U.S.C. 154(b) by 240 days.

(21) Appl. No.: 13/810,435

(22) PCT Filed: Jul. 15, 2011

(86) PCT No.: PCT/BE2011/000047

§ 371 (c)(1),
(2), (4) Date: Jan. 15, 2013

(87) PCT Pub. No.: WO2012/006693

PCT Pub. Date: Jan. 19, 2012

(65) Prior Publication Data

US 2013/0112500 A1 May 9, 2013

(30) Foreign Application Priority Data

Jul. 16, 2010 (BE) ..... 2010/0443
May 6, 2011 (BE) ..... 2011/0279
May 6, 2011 (WO) ..... PCT/BE2011/000012

(51) Int. Cl.

| | |
|---|---|
| ***E04G 1/22*** | (2006.01) |
| ***B66B 9/02*** | (2006.01) |
| ***B66B 9/187*** | (2006.01) |
| ***E04G 1/20*** | (2006.01) |
| ***E04G 1/24*** | (2006.01) |
| ***E04G 1/18*** | (2006.01) |

(52) U.S. Cl.

CPC ... *E04G 1/22* (2013.01); *B66B 9/02* (2013.01); *B66B 9/187* (2013.01); *E04G 1/18* (2013.01); *E04G 1/20* (2013.01); *E04G 1/24* (2013.01)

(58) Field of Classification Search

CPC ..... E04G 1/15; E04G 1/22; E04G 1/362; E04G 5/007; E04G 3/28; E04G 3/305; B66F 11/042

See application file for complete search history.

(56) References Cited

U.S. PATENT DOCUMENTS

| | | | | | |
|---|---|---|---|---|---|
| 548,752 | A | * | 10/1895 | Gentry | 187/270 |
| 849,222 | A | * | 4/1907 | Flemming | 182/62.5 |
| 2,948,363 | A | * | 8/1960 | Hopfeld | 182/141 |
| 2,959,244 | A | * | 11/1960 | Fedde | 182/69.5 |
| 3,664,459 | A | * | 5/1972 | Stephens et al. | 182/141 |
| 3,889,778 | A | * | 6/1975 | Dotts | 182/17 |
| 4,294,332 | A | * | 10/1981 | Ready | 182/141 |
| 4,468,904 | A | * | 9/1984 | O'Malley | 52/111 |
| 4,809,814 | A | | 3/1989 | St-Germain | |
| 4,967,733 | A | * | 11/1990 | Rousseau | 182/13 |

(Continued)

FOREIGN PATENT DOCUMENTS

| | | |
|---|---|---|
| GB | 2425563 | 11/2006 |
| GB | 2461782 | 1/2010 |
| WO | WO 9850301 | 11/1998 |

*Primary Examiner* — Colleen M Chavchavadze
(74) *Attorney, Agent, or Firm* — Marcus C. Dawes; Daniel L. Dawes

(57) ABSTRACT

Described is a lift unit for ascending and descending in a shaft formed by a scaffold column of a scaffold, the scaffold column comprising at least one scaffold section, each scaffold section being defined by uprights and ledgers, comprising a first part adapted to be fixed at different heights to the scaffold by means of a first set of fixing means; a second part adapted so that it can be fixed at different heights to the scaffold by means of a second set of fixing means; a distance control means adapted to drive a variation in the distance between the first set of fixing means and the second set of fixing means; and methods for use of the lift unit.

13 Claims, 26 Drawing Sheets

(56) References Cited

U.S. PATENT DOCUMENTS

| | | | | |
|---|---|---|---|---|
| 5,259,479 | A | 11/1993 | St-Germain | |
| 5,310,018 | A * | 5/1994 | Lahaie | 182/141 |
| 5,579,865 | A | 12/1996 | Butler et al. | |
| 6,182,791 | B1 | 2/2001 | Cope | |
| 7,726,690 | B1 * | 6/2010 | James et al. | 280/764.1 |
| 8,616,388 | B2 * | 12/2013 | Butler | 211/187 |
| 2007/0187184 | A1 | 8/2007 | Nasuti | |
| 2008/0105497 | A1 * | 5/2008 | Ashley et al. | 187/269 |
| 2015/0107186 | A1 * | 4/2015 | Wilts | B66B 19/002 52/741.1 |

* cited by examiner

LIFT UNIT FOR ASCENDING AND DESCENDING A SCAFFOLD

The present invention relates to the field of scaffolds.

BACKGROUND

The prior art comprises lift systems for use in combination with scaffolds.

Existing lift systems have different problems. A lift can for instance be insufficiently stable or unstable in the scaffold. The installation of a lift in a scaffold may also necessitate a substantial modification of the scaffolding material to the use of a determined lift, and this can affect different aspects of the scaffold device itself: weight, strength, load-bearing capacity, transportability, handling and speed of erection of a scaffold are some examples. The lift may also be adapted substantially for use in combination with one specific scaffold type, so that the lift cannot be used for other scaffold types.

The lifts may also have a relatively low load-bearing capacity. The safety aspect is also very important in the use of a scaffold lift.

It is known that erection and dismantling of a scaffold is very labour-intensive. This means that a relatively large amount of time is lost in the erection of particularly larger scaffolds. The physical load for people erecting the scaffolds is further a heavy one, so that many people can only perform this task for a limited part of their life.

There is a need for alternative lift systems which resolve at least some of the above stated problems.

SUMMARY OF THE INVENTION

For the purpose of the present invention use has been made of the following terminology:

- in this description the terms "vertical" and "horizontal" are used. These terms must be interpreted as follows: the direction running substantially parallel to the direction of the force of gravity is the vertical direction, while the direction perpendicularly of this direction is the horizontal direction.
- "fixing at a determined height" of the first and second part refers to the height where the respective part, in particular the corresponding fixing means, are fixed to or couple to the scaffold. In typical embodiments this can correspond to a height of a ledger level of the scaffold.

In a first aspect of the present invention a lift unit for ascending and descending in a scaffold is described, the scaffold comprising at least one scaffold section, each scaffold section being defined by uprights and ledgers which secure these uprights relative to each other, comprising

- a first part adapted so that it can be fixed at different heights to the scaffold by means of a first set of fixing means;
- a second part adapted so that it can be fixed at different heights to the scaffold by means of a second set of fixing means;
- a distance control means or spacing means adapted to drive a variation in the distance between the first set of fixing means and the second set of fixing means.

In preferred embodiments the second part is preferably never fixed at lower height than the first part during use of the lift unit.

The scaffold preferably comprises at least one scaffold section. A scaffold section can be defined as comprising two sets of four ledgers which form equal rectangles which lie substantially in horizontal planes and which are connected to each other by means of (for instance four) uprights at their corresponding corners.

The lift unit can be adapted such that the relative distance between the first part and the second part can be increased and decreased. The distance control means is thus preferably able to push apart the second part and the first part in driven manner. When only the first part is fixed, this increase in distance will involve the second part being pushed upward, while a decrease in distance will involve the second part being lowered relative to the first part. When only the second part is fixed, decreasing the distance between the second part and the first part corresponds to pulling the first part upward. An increase in distance between the first part and the second part involves in this case lowering of the first part under the second part.

The fixing can for instance take place at or on the ledgers and/or uprights of the scaffold.

In preferred embodiments the lift unit is adapted to make an ascending movement in the scaffold by performing one or more times the following sequence of steps of:

- pushing the second set of fixing means upward relative to a fixed first set of fixing means;
- fixing the second set of fixing means above the first set of fixing means;
- pulling the first set of fixing means relative to a fixed second set of fixing means upward in the direction of the fixed second set of fixing means; and
- fixing the first set of fixing means.

Before a fixed first or second set of fixing means can be displaced again, it may be necessary for the fixing means of this set to be first released or uncoupled from the scaffold (for instance from the ledger or upright).

In preferred embodiments the lift unit is further adapted during the ascending movement to fix the first set of fixing means each time at the previous height of the second set of fixing means.

In preferred embodiments the lift unit is further adapted during the ascending movement to cause the first set of fixing means to temporarily rise above the second set of fixing means before fixing the first set of fixing means.

In preferred embodiments the first part comprises a first set of fixing means which can together be fixed at determined heights in the scaffold, and the second part comprises a second set of fixing means which can together be fixed at determined heights in the scaffold.

The different heights can for instance correspond to the ledger levels of the upright or to the heights of the so-called rosette levels of a scaffold of the Layher™ type.

The different heights can for instance also correspond to the levels of holes present in the uprights, as described for instance in WO 2010/045693 in the name of applicant. The specification of such a type of upright, and other scaffolding material described therein, is hereby included by reference from WO 2010/045693. All embodiments of the present invention can be implemented on the scaffolding material described in this application or can be used in the context of such scaffolding material.

The fixing means of the first and/or second set of fixing means can take different forms. They can for instance comprise coupling structures of the claw type. The coupling structures can for instance be hooked over the ledgers.

The fixing means of the same set are preferably arranged or can be temporarily positioned close to the uprights of a scaffold section/scaffold column. In preferred embodiments there are four fixing means associated with the four respective uprights, wherein the fixing means can be coupled to the two ledgers coupled in each case to the respective uprights.

The first set and/or the second set of fixing means can be adapted for fixing to at least two ledgers at the same level of the same scaffold section. The first set and/or the second set of fixing means can be adapted for fixing to the four ledgers at the same level of the same scaffold section.

Each of the fixing means of the first set and/or the second set of fixing means is adapted for fixing to two of the four ledgers at the same level of a scaffold section, wherein these two ledgers are adjacent.

Each of the fixing means of the first set and/or the second set of fixing means can be adapted for fixing to at least two ledgers at the same level of the same scaffold section.

According to preferred embodiments of the present invention, the distance control means comprise one or more extendable and retractable cylinders. These cylinders can for instance be of the hydraulic, pneumatic or electrical type.

In alternative embodiments the distance control means can comprise a scissor lift.

In other further embodiments the distance control means can comprise one or more upright running chain, cable or belt systems on which the second set of fixing means is arranged. The second set of fixing means can for instance comprise four claws which are connected to four corresponding drivable/windable chains or cables forming part of the spacing means. The other outer end of the respective chains or cables can for instance be connected to a drivable wind-up mechanism which can complete the spacing means. The wind-up mechanism is preferably situated under the work-floor of the climbing lift. The four chains can be guided upward from below this work-floor and along the side of the work-floor or climbing lift. This can take place by means of at least one guide wheel for each of the chains or cables. These guide wheels are preferably situated on the outer side of the climbing lift. It should be noted that the length of such cables or chains need typically be no longer than that necessary to be able to reach the ledger level lying above. In determined embodiments these chains can however be much longer, and long enough to exceed a predetermined height of a scaffold. In such cases the climbing lift, once it has ascended to the upper level of a scaffold (for instance in the erection phase), can function as a lift cage or lift system in accordance with any of the embodiments of the sixth aspect of the present invention, wherein the chains or cables serve as hoisting means.

In other further embodiments the distance control means comprises one or more threaded spindles.

In preferred embodiments the above described spacing means respectively comprise four cylinders, endless chain or belt systems or threaded spindles which are substantially upright, one close to each corner of the scaffold section/the scaffold column. At the bottom the cylinders, endless chain or belt systems or threaded spindles can be mounted rotatably about a rotation point or rotation axis on the first part so that pivoting away around the rotation point/the rotation axis toward the interior of the scaffold section is possible. At the top the cylinders, endless chain or belt systems or threaded spindles can comprise the fixing means of the second set of fixing means.

In preferred embodiments the fixing means of the first and the second set of fixing means are adapted to be placed in a position which allows non-interference by obstacles during varying of the distance between the first set and the second set of fixing means. The positions of the fixing means of the first and/or second set of fixing means can preferably change in such manner during ascent or descent, i.e. during varying of the distance therebetween.

These obstacles can comprise ledgers or consist of ledgers. These ledgers can form part of the level of the scaffold lying above/below. These obstacles can also comprise cotters or rosettes of for instance uprights of the Layher™ type.

These obstacles can also comprise coupling structures for ledgers arranged on the uprights of the scaffold. These obstacles to the fixing means of the first or second part can also be respective fixing means of the second or first part.

According to preferred embodiments of the present invention, the fixing means of the first and/or second set are adapted so that they can be retracted or pivot away toward the central part of the lift unit. They can also be rotated away, for instance in a substantially horizontal plane.

According to preferred embodiments of the present invention, the fixing means of the first and second set of fixing means are adapted to be placed in a position which allows them to not obstruct each other during varying of the distance between the first set and the second set of fixing means, wherein the first set and the second set move adjacently of each other in height direction.

According to preferred embodiments of the present invention, the upright further comprises guide means for guiding the movement of the lift unit along the uprights in the scaffold column.

In preferred embodiments the first part comprises a work-floor.

In preferred embodiments the second part comprises a work-floor.

The first part or the second part can further comprise a base platform comprising drive means of the distance control means.

The base platform can be comprised in the first part and the work-floor in the second part. The base platform can be comprised in the second part and the work-floor in the first part.

A lift unit according to the first aspect of the present invention can further comprise displacing means adapted for coupling to a rail system, the rail system being adapted so that it can be arranged inside and through at least two horizontally adjacent scaffold sections for the purpose of guiding a horizontal displacement of the lift unit through the adjacent scaffold sections.

In a second aspect of the present invention a method is described for ascending in a scaffold using a lift unit according to any of the embodiments of the first aspect of the present invention placed in this scaffold, the method comprising of

- fixing a first set of fixing means at a first height in the scaffold;
- causing the distance between the first set and the second set to increase, pushing the second set upward in the scaffold here to a second height which is greater than the first height;
- fixing the second set in the scaffold at the second height;
- causing the distance between the second set and the first set to decrease by pulling the first set upward from a third height toward the fixed second set;
- fixing the first set at a fourth height in the scaffold, the fourth height being greater than the third height.

In preferred embodiments the difference in height between the first height and the second height is equal to the difference in height between the third height and the fourth height.

In preferred embodiments the first height and the third height are the same and the second and the fourth height are the same.

In preferred embodiments the first and the second height correspond to the height of two successive levels of ledgers in a scaffold.

In preferred embodiments the difference in height between the first height and the second height is equal to the difference in height between the third height and the fourth height, and the first height and the third height are the same and the second and the fourth height are the same.

In a third aspect of the present invention a method is described for descending in a scaffold using the lift unit according to the first aspect placed in a scaffold column of this scaffold, comprising of fixing the second set of fixing means at a fourth height in the scaffold;

causing the distance between the fixed second set of fixing means and the first set of fixing means to increase, carrying the first set of fixing means downward here in the scaffold to a third height which is lower than the fourth height;

fixing the first set of fixing means in the scaffold at the third height;

causing the distance between the first set of fixing means and the second set of fixing means to decrease by lowering the second set of fixing means from a second height toward the fixed first set of fixing means;

fixing the second set of fixing means at a first height in the scaffold, the first height being smaller than the second height.

In preferred embodiments the difference in height between the first height and the second height is equal to the difference in height between the third height and the fourth height.

In preferred embodiments the first height and the third height are the same and the second and the fourth height are the same.

In preferred embodiments the first and the second height correspond to the height of two successive levels of ledgers in a scaffold.

In preferred embodiments of the second or third aspect of the present invention the method further comprises of temporarily displacing the fixing means of the second part or the first part in order to avoid obstacles during upward or downward movement in the scaffold.

It should be noted that, during descent in a scaffold according to determined embodiments of the present invention, lowering of the second set of coupling means and the first set of coupling means by uncoupling the respective coupling structures from the corresponding ledgers can include a "lift-out" action which first raises the underside of the coupling structures of the respective fixing means to a level lying above the upper surface of the respective ledgers. This particularly when the coupling structures comprise one or more recesses at the bottom which have to be arranged over the respective ledgers.

In a fourth aspect of the present invention a method is described for erecting a scaffold, comprising of:

a. placing the lift unit according to the first aspect in the highest scaffold section of a scaffold column so that the second part is fixed to the upper ledger level of the scaffold section;

b. erecting an even higher scaffold section on top of the previously highest scaffold section, wherein a new, still higher ledger level is created;

c. causing the lift to ascend to the newly created ledger level in accordance with the method according to the second aspect of the present invention.

In a fifth aspect of the present invention a method is described for dismantling a scaffold, comprising of:

a. placing the lift unit according to the first aspect of the present invention in the highest scaffold section of a scaffold column so that the second part is fixed to the lower ledger level of the scaffold section;

b. dismantling the uprights and upper ledgers of the scaffold section;

c. causing the lift unit to descend to the next ledger level below in accordance with the method according to the third aspect of the present invention.

In a six aspect of the present invention a lift system is described for use in a scaffold column of a scaffold, the scaffold column comprising at least one scaffold section, each scaffold section being substantially defined by uprights and ledgers, the lift system comprising:

a lift unit;

a hoisting means which is adapted at a first outer end thereof to be coupled to the scaffold and is adapted at a second outer end thereof to be coupled, or is coupled to the lift unit, and which is adapted to control the ascent or descent of the lift unit in the scaffold.

In preferred embodiments the scaffold sections are substantially defined by uprights and a lower set and an upper set of ledgers respectively connecting the uprights to each other at the bottom and at the top, and the hoisting means is adapted for coupling to at least one ledger.

In preferred embodiments the hoisting means is adapted for coupling to a set of ledgers forming part of the same scaffold section at the same level.

In preferred embodiments the lift unit is substantially rectangular and the hoisting means comprises four chains or cables, each of the chains or cables being arranged at a first outer end close to the respective corners of the lift unit and at a second outer end on a respective claw adapted for coupling to at least one ledger.

In preferred embodiments each of the claws is adapted for coupling to a lengthwise ledger and adjacent width ledger close to the uprights corresponding to the corners of the lift unit.

In preferred embodiments the lift unit further comprises a work-floor and a guard element arranged between each chain or cable and the work-floor at the position of the movement space of a workman on the work-floor during use.

In alternative embodiments the lift system comprises a frame adapted for mounting on a part of the scaffold and adapted to bear one or more hoisting means internally on a scaffold column. The hoisting means is/are preferably adapted for coupling at the first outer end thereof to the frame.

In preferred embodiments the hoisting means comprises a hoist.

In preferred embodiments the hoisting means comprises a reverse hoist.

In preferred embodiments the scaffold sections are defined substantially by uprights and a lower set and an upper set of ledgers respectively connecting the uprights to each other at the bottom and at the top, and the frame is adapted for mounting at or on the upper set of ledgers and/or the uprights of an upper scaffold section. The frame can thus be adapted for instance for coupling to connecting pins arranged/present in the upper outer end of uprights, typically for the purpose of coupling to uprights lying above.

In preferred embodiments the lift system further comprises guide means for guiding the movement of the lift unit in the scaffold column.

In preferred embodiments the guide means comprise a scaffold part and a lift part.

In preferred embodiments the scaffold part of the guide means comprises guide tracks along one or more uprights. A guide track can be present along each of the uprights. These guide tracks can be integrated with the uprights. They can also be coupled to and uncoupled from the uprights, wherein they can be adapted to couple to a determined existing type of upright, such as for instance the uprights of the Layher™ type.

In preferred embodiments the scaffold part of the guide means comprises guide tracks which are arranged parallel to the uprights and mounted on the ledgers.

In preferred embodiments the lift part of the guide means comprises guide wheels adapted so that they can co-act with the guide tracks on the scaffold.

In preferred embodiments the scaffold part of the guide means comprises guide wheels.

In preferred embodiments the guide wheels are mounted on the ledgers.

In preferred embodiments the lift part of the guide means comprises at least one guide track which is arranged parallel to the uprights and adapted for co-action with guide wheels on the scaffold when the lift unit is placed in the scaffold.

In preferred embodiments the lift system comprises two guide tracks which are arranged on opposite sides of the lift unit and which co-act with respective guide wheels on the upright, wherein the guide wheels and the guide tracks are adapted to co-act in a manner such that a deviation in the direction of the guide tracks occurring relative to the direction of the uprights is countered or avoided.

In preferred embodiments the guide tracks that are present have a length which is great enough to always co-act during use with guide wheels of at least two successive ledger levels.

The hoists or reverse hoist can be suitable prior art hoists. They can thus be chain hoists or steel wire hoists. The hoists can for instance be electrically, pneumatically or manually driven.

The hoisting means can further also comprise for instance a blocking means for safety reasons, this for instance for the purpose of preventing the hoisted lift unit being able to slide downward in the case of a malfunction of the hoisting means. In addition to a hoist or reverse hoist, the hoisting means can comprise for this purpose one or more additional guide cables or chains.

In preferred embodiments the lift unit comprises an upper frame which is adapted for coupling to the hoisting means.

In preferred embodiments the lift unit comprises a work-floor, and the coupling between the hoisting means and the lift unit takes place under the work-floor, the hoisting means passing here through an opening in the work-floor.

In preferred embodiments the work-floor comprises a stacking means for scaffolding material, the stacking means comprising the opening.

In preferred embodiments the lift unit comprises an upper frame situated above the work-floor, the upper frame being adapted to guide the hoisting means.

In preferred embodiments the lift unit is a lift unit according to the first aspect of the present invention.

A lift unit according to the sixth aspect of the present invention can further comprise displacing means adapted for coupling to a rail system, the rail system being adapted so that it can be arranged inside and through at least two horizontally adjacent scaffold sections in order to guide a horizontal displacement of the lift unit through the adjacent scaffold sections.

In a seventh aspect of the present invention a displacing system is described for a displaceable unit for use inside a scaffold comprising at least two mutually adjacent scaffold sections, which system allows displacement of the displaceable unit through at least two mutually adjoining, laterally adjacent scaffold sections.

The displaceable unit is adapted here and of suitable dimensions such as to be able to move through the scaffold in substantially horizontal direction along one, two or more guide tracks, such as for instance rails.

These guide tracks are preferably adapted so that they can be mounted on the ledgers at the same ledger level, preferably through at least two adjoining, laterally adjacent scaffold sections.

The displaceable unit can be a lift unit according to any of the embodiments of the present invention which comprises displacing means, such as for instance wheel mechanisms, which are adapted for guiding along the guide tracks.

The displaceable unit can also be an independent carrier unit (e.g. a carriage, trolley) which can be placed in the scaffold and which comprises displacing means, such as for instance wheel mechanisms, adapted to be guided along the guide tracks. Such a trolley can be used to carry and displace a lift unit according to any of the embodiments of the present invention.

A first set of guide tracks or rails of the displacing system can further comprise point switching means which allow the displaceable unit to be guided to a second set of guide tracks.

In preferred embodiments the second set of guide tracks forms substantially a right angle with the first set.

In determined embodiments the second set of guide tracks can preferably come out of the scaffold at the front and connect the first set of guide tracks to a ground level. A lift unit with displacing means can then be guided upward for instance from the ground level via the second set of guide tracks to the point switches, and thus to the first set of guide tracks.

Further aspects of the present invention are described in the sub-claims. The features of the sub-claims, features of any of the sub-claims and any of the features of other sub-claims can be combined and be deemed suitable by the skilled person, and not only in the specific combinations as defined by the claims.

BRIEF DESCRIPTION OF THE DRAWINGS

The accompanying drawings are used to illustrate embodiments of the present invention.

Reference numerals are chosen such that they are the same for similar of the same elements or features in different figures or drawings.

DESCRIPTION OF ILLUSTRATIVE EXAMPLES

The above stated and other advantageous features and objects of the invention will become more apparent and the invention better understood from the following detailed description when read in combination with the respective drawings.

The description of the aspects of the present invention is given by means of specific embodiments and with reference to, but not limited to, specific drawings. The figures shown are only schematic and should be deemed as non-limitative. Determined elements or features may for instance be shown out of proportion or not to scale in relation to other elements.

Figure 1:
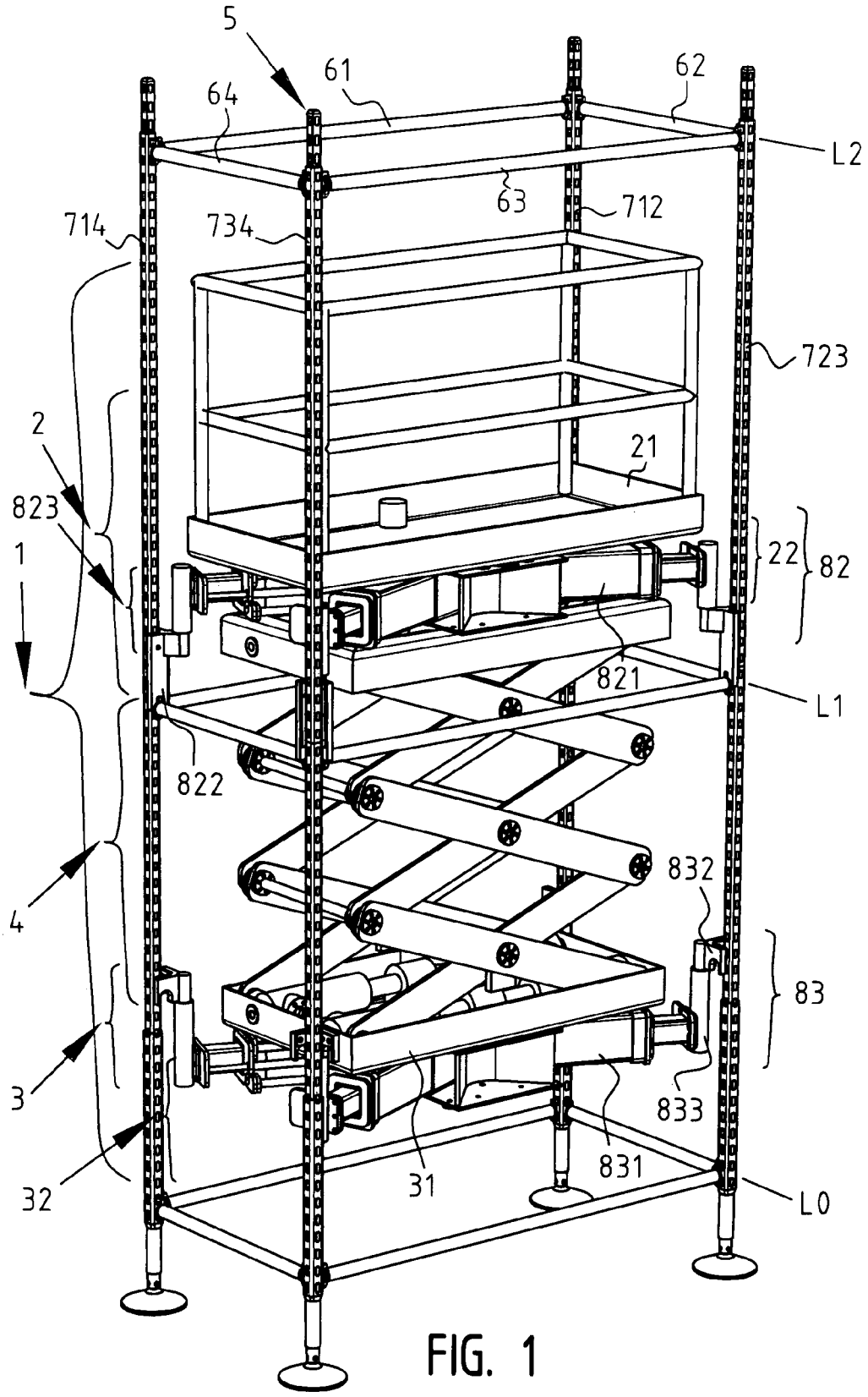
FIG. 1 shows embodiments of the present invention. The scaffold lift is placed in the scaffold such that the second part/the work-floor is fixed relative to a first level of ledgers in the scaffold, while the first part/base platform is held at a position under the work-floor by means of the (main) distance control means without being connected here to the scaffold in this intermediate step.

FIG. 1 shows a first example of a device according to the first aspect of the present invention.

Shown in FIG. 1 is a scaffolding construction 5 which comprises a number of scaffold sections forming a scaffold column. The scaffold is constructed from uprights 7 (714, 712, 723, 734) and ledgers 6 (61, 62, 63, 64) defining these scaffold sections; a scaffold section comprises at the bottom four ledgers which connect four uprights to each other, and also comprises at the top four ledgers connecting the same uprights to each other such that a typically beam-like structure of the scaffold sections is obtained.

The scaffold shown in FIG. 1 comprises uprights of square cross-section which are further provided with openings in which the ledgers can engage. This is not however necessarily required for the use of a lift unit according to embodiments of the present invention. The lift units according to aspects of the present invention can likewise be used in combination with other prior art scaffolding construction elements, such as in combination with scaffolds of the Layher™ type, as will be appreciated by the skilled person. The successive levels of ledgers in the scaffold are designated with $L_0, L_1, L_2, \ldots$. The scaffold lift comprises a second part comprising a work-floor 2 with a working area 21 located above an active part 22 of the work-floor. The active part comprises mounting means for the work-floor which comprise for instance four extendable and retractable arms 821 in addition to coupling structures 822 adapted for coupling to the ledgers of a scaffold. In preferred embodiments the mounting means 82 of the work-floor further also comprise distance correction means 823 which are adapted to place the work-floor in a horizontal position at all times, even it there were to be, typically very small, height differences between the ledgers in the four corners of a scaffold section at substantially the same level. In preferred embodiments the extendable/retractable arms of work-floor 821 can further also be reoriented and/or displaced in a substantially horizontal plane. The inward directed outer end of arms 823 can thus be mounted rotatably round a rotation point. The work-floor can also be provided at the top with a railing which can serve as support for the user, and can also comprise predefined storage sections or storage means in which scaffolding material can be arranged or stacked in a predefined manner.

The main distance control means 4, which is adapted to vary the distance between the work-floor and the first part comprising a base platform, is embodied here as a scissor lift. Other main distance control means which can fulfil the same function can also be used, as will be appreciated by the skilled person. Examples hereof can for instance be (for instance upright) cylinders, (for instance upright) endless chain or belt systems, or (for instance upright) threaded spindles. A scissor lift can be arranged in a manner which does not further obstruct the arrangement of further components of the base platform. In preferred embodiments of the present invention a drive means is thus present in (for instance on the support surface or upper surface) the base platform, such as for instance a motor or hydraulic drive system. The base platform can also comprise the necessary electronics. Such a scissor lift can further be driven hydraulically in simple manner.

The scissor lift (or main distance control means 4) provides for the connection to the base platform 3/first part. The base platform can comprise a support surface 31 (not shown) as well as an active part of base platform 32. Similarly to the active part of work-floor 22, the active part 32 of the base platform comprises mounting means 83. These mounting means 83 comprise for instance four similar extendable/retractable arms 831 which can preferably also rotate around a rotation point on their inward directed outer end. They further also comprise coupling structures for base platform 832 adapted for mounting on the ledgers of a scaffold, and preferably also distance correction means 833. In preferred embodiments these extendable/retractable arms 831 can preferably also be reoriented or displaced, similarly to the arms 821 of the work-floor.

Figure 2:
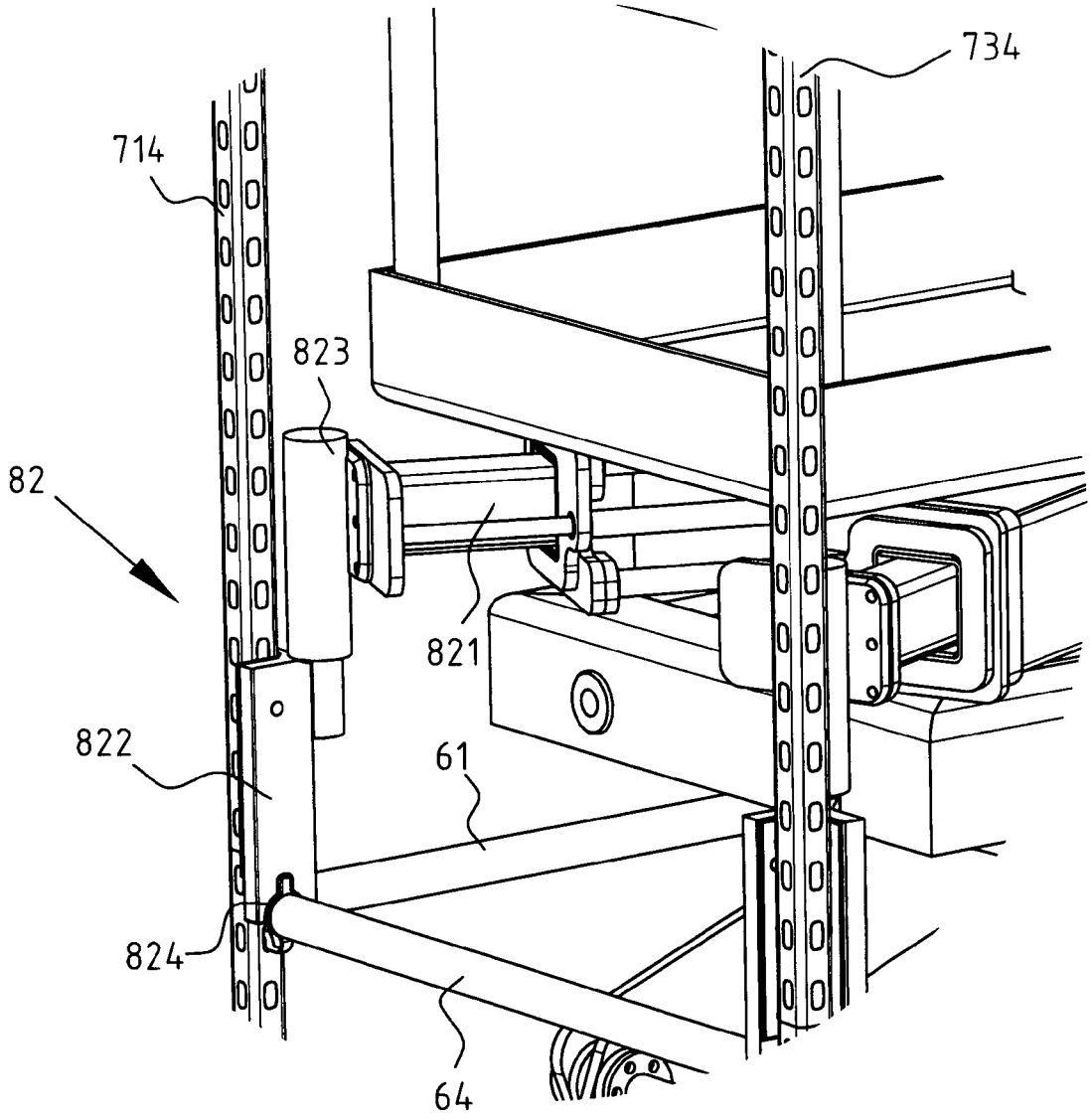
FIGS. 2-6 illustrate the aspect of embodiments of the present invention wherein the base platform is pulled to the work-floor by means of the main distance control means, following which both the work-floor and the base platform are fixed at a first level of ledgers.

FIG. 2 shows a detail view of the mounting means 82 for the work-floor when these are fixed at a first level of ledgers of the scaffold. The extendable/retractable arm 821 is connected to the distance correction means 823, which is further connected to coupling structure 822 which is coupled to two adjacent ledgers 61 and 64 close to upright 714. The inner surface of the coupling structure here makes contact with or preferably connects to the surface of the upright in order to thus block the movement of the work-floor in a horizontal plane relative to the upright. Note that each of the four mounting means 82 are arranged in similar manner relative to the respective uprights, and that the position of the work-floor is consequently fixed in a horizontal plane by the four uprights. Coupling structure 822 is preferably provided on the underside with a recess 824 adapted to engage on the associated ledgers. For ledgers with a circular cross-section as shown in FIG. 2 a circular recess can be appropriate, while for ledgers with for instance a rectangular cross-section a corresponding rectangular recess can be appropriate. The skilled person can develop other coupling structures adapted to the specific ledgers. Nor is it strictly necessary for the inner surface of this coupling structure 822 to adjoin the surface of the upright, and this coupling structure can also engage on two adjacent ledgers 61, 64 at a distance from the respective surface of the upright corresponding to a distance greater than for instance the rosette of a ledger of the Layher™ type.

Figure 3:
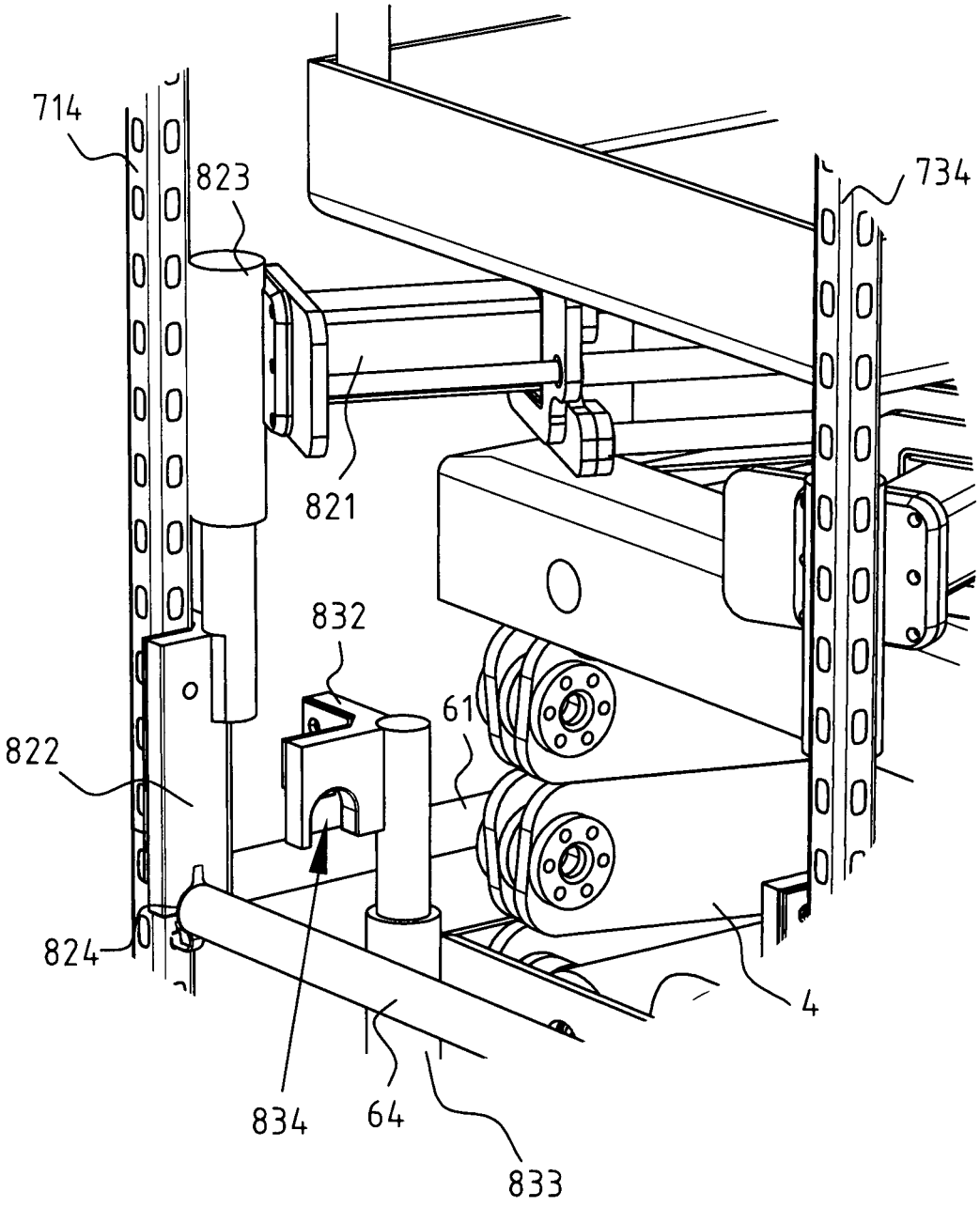
Figure 4:
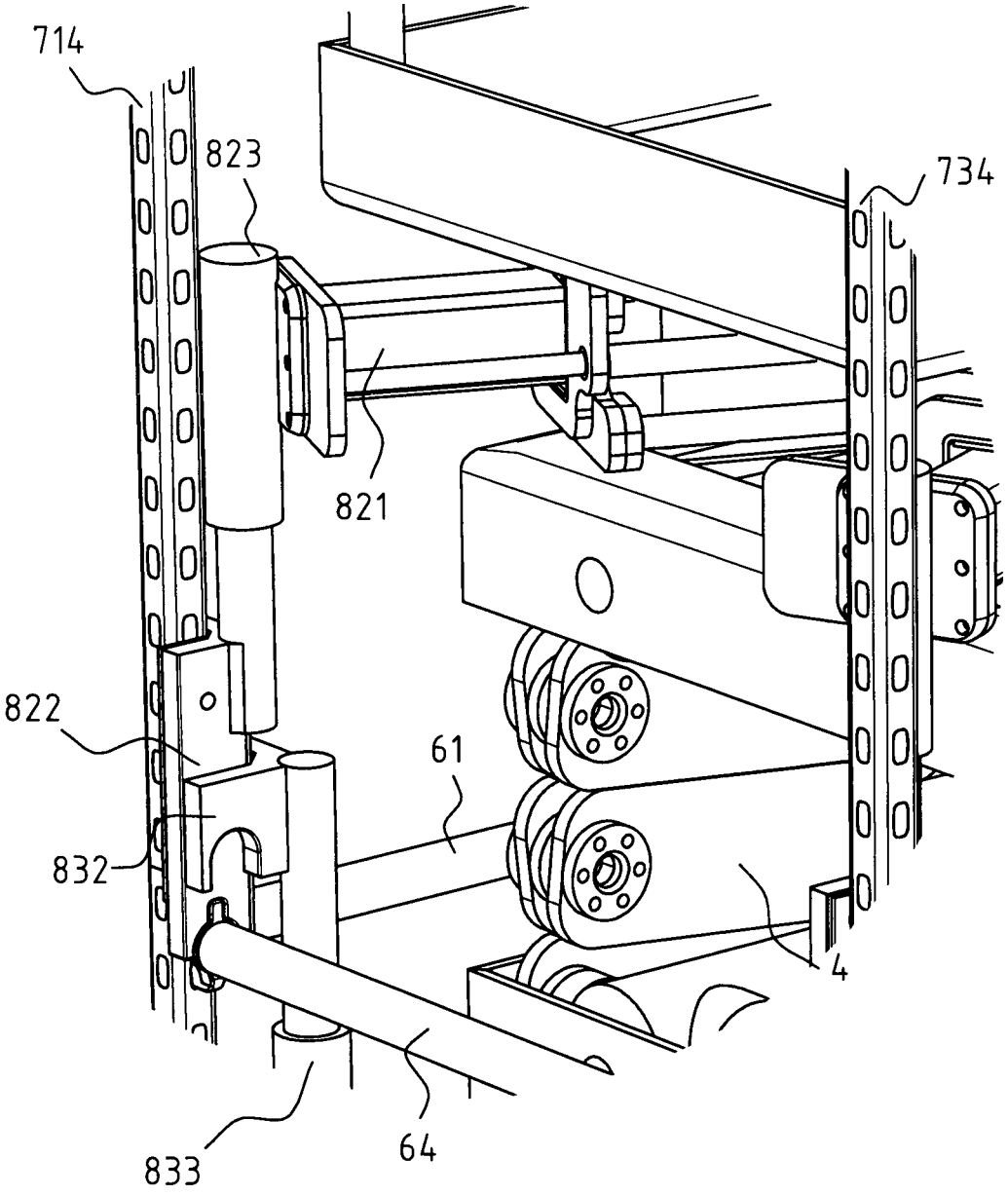

FIG. 3 shows the result of the action wherein the main distance control means 4 pulls the underlying base platform/first part upward such that coupling structures 832 of the base platform rise above the first level of the ledgers, optionally also making use of extending of the distance correction means 833 of the base platform, and at a position in the scaffold where this coupling structure 832 would not be blocked by ledgers 61 and 64. This is achieved by moving the coupling structure of base platform 832 and distance correction means 833 to the centre of the scaffold section by means of retracting the respective arms 831. Once this level has been reached, and the possible obstacles avoided, the coupling structure 832 of the base platform can, as shown in FIG. 4, be shifted outward again together with the distance correction means 833 of the base platform by means of extending the corresponding arm 831. The underside of the coupling structure of the fixing means of the base platform is situated here above the upper level of the corresponding ledgers.

Figure 5:
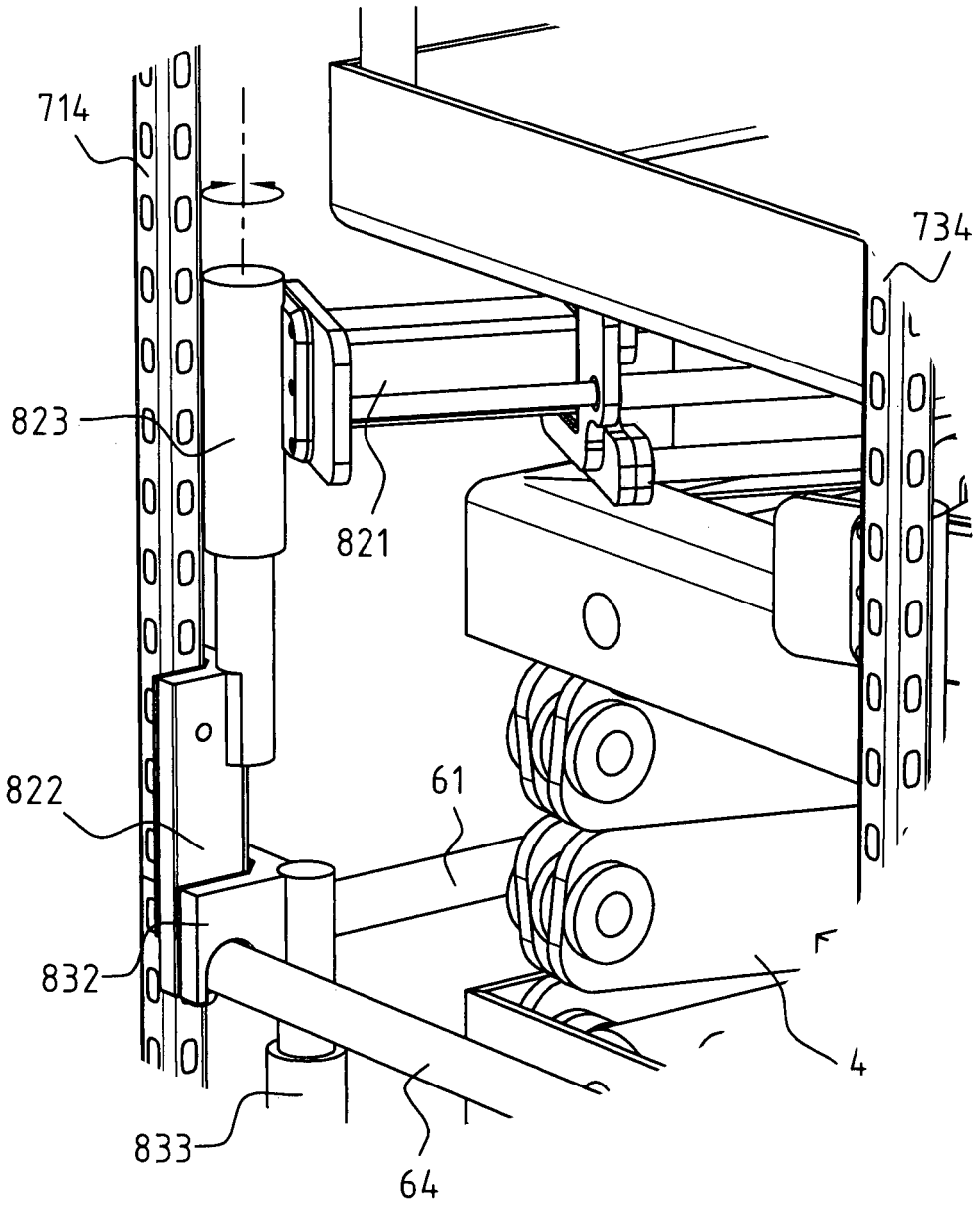
Figure 6:
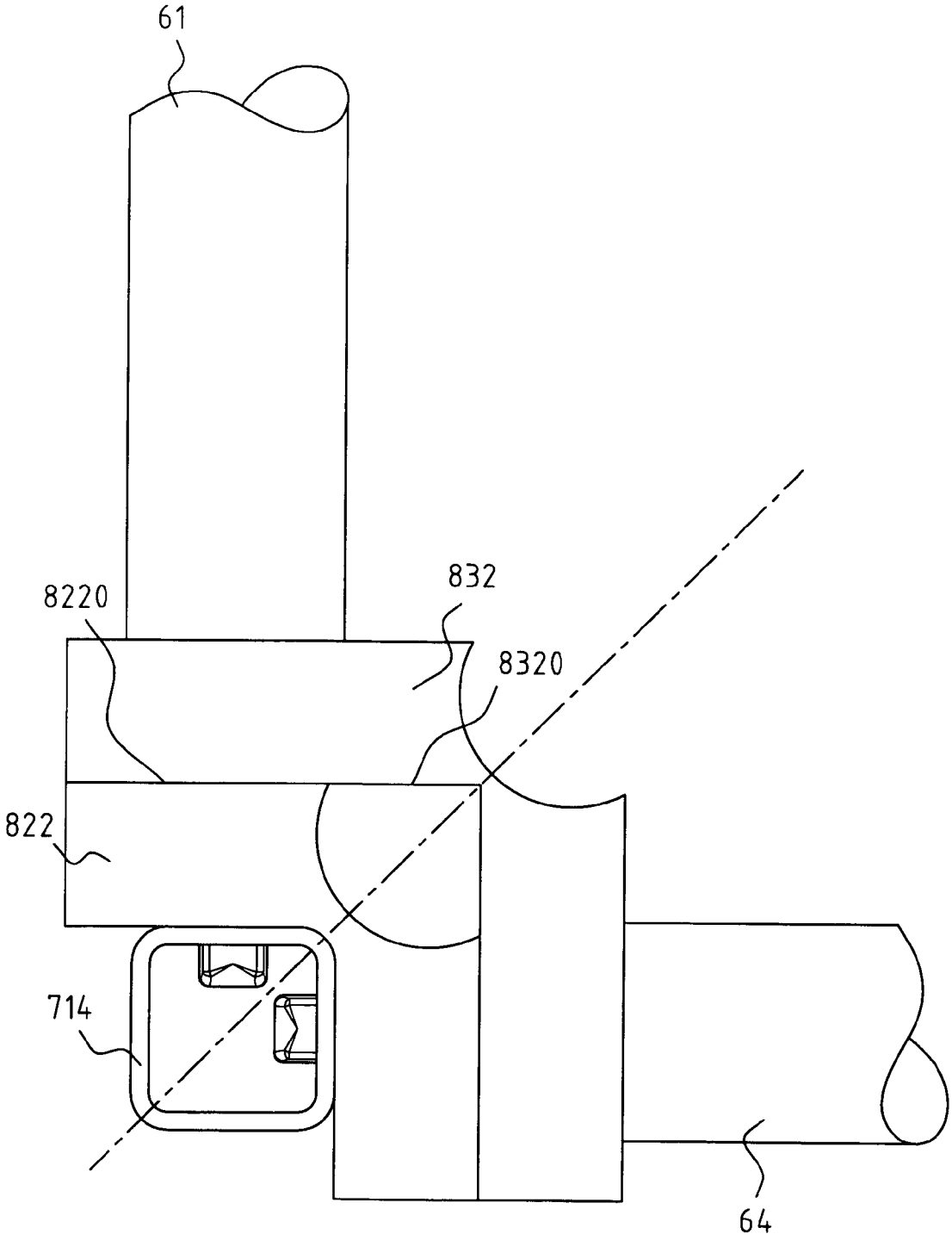

As illustrated in FIG. 5, coupling structure 832 is then coupled to ledgers 61 and 64, for instance by arranging the corresponding recesses in the coupling structure over these ledgers. This can take place by varying the main distance control means 4 and/or the distance correction means 833. In preferred embodiments the outer surface 8220 of coupling structure 822 will adjoin the inner surface 8320 of coupling structure 832 as shown in FIG. 6. Such a configuration improves the stability of the lift unit in the scaffold. The contact surface between surfaces 8220 and 8320 can be further provided with a suitable material adapted to facilitate sliding of coupling structures 822 and 832 adjacently of each other with little wear (for instance a lubricant such as grease or a suitable plastic material).

Figure 7:
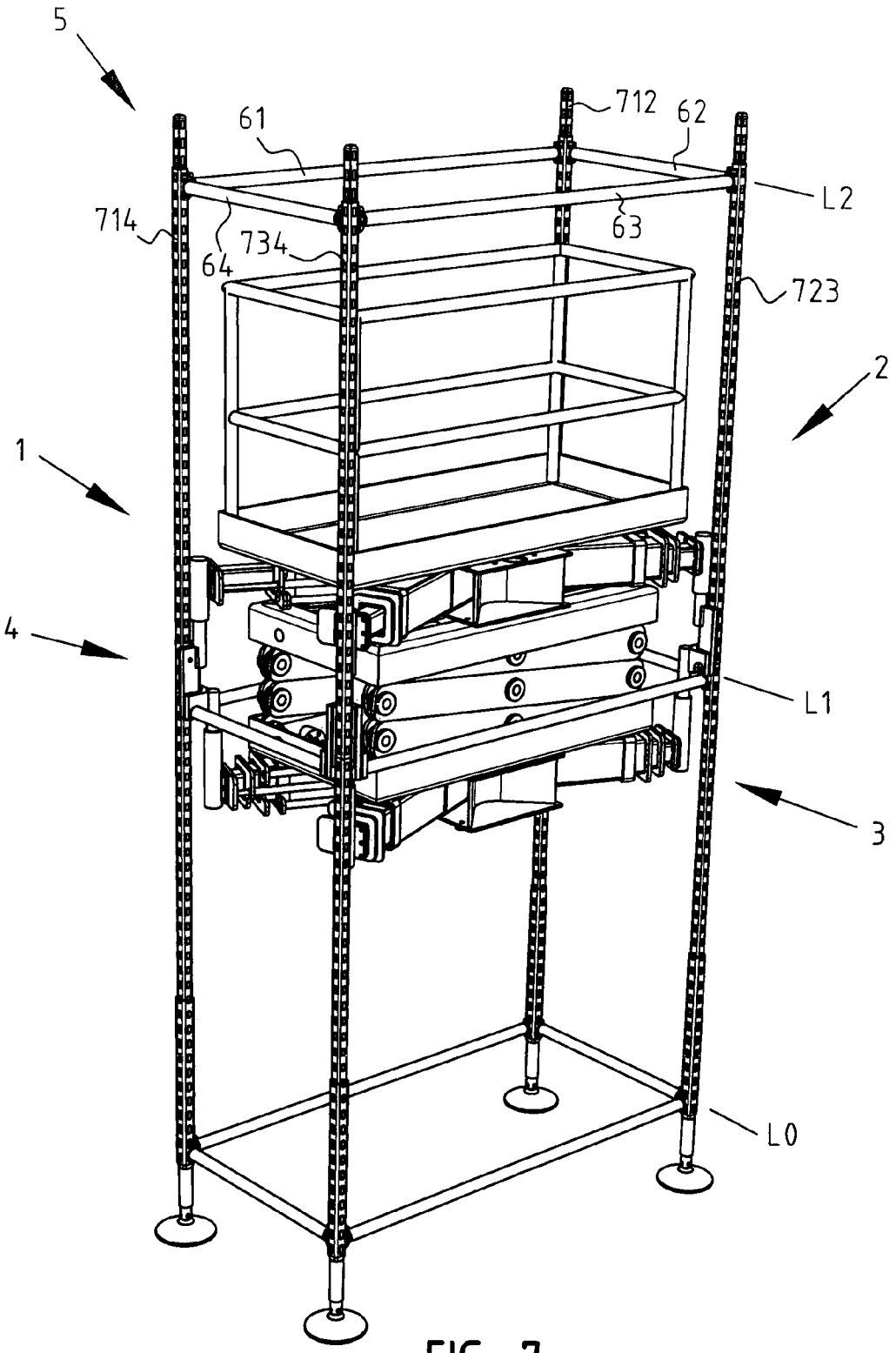

FIG. 7 shows the lift unit in the scaffold in the position corresponding to FIGS. 5 and 6.

Figure 8:
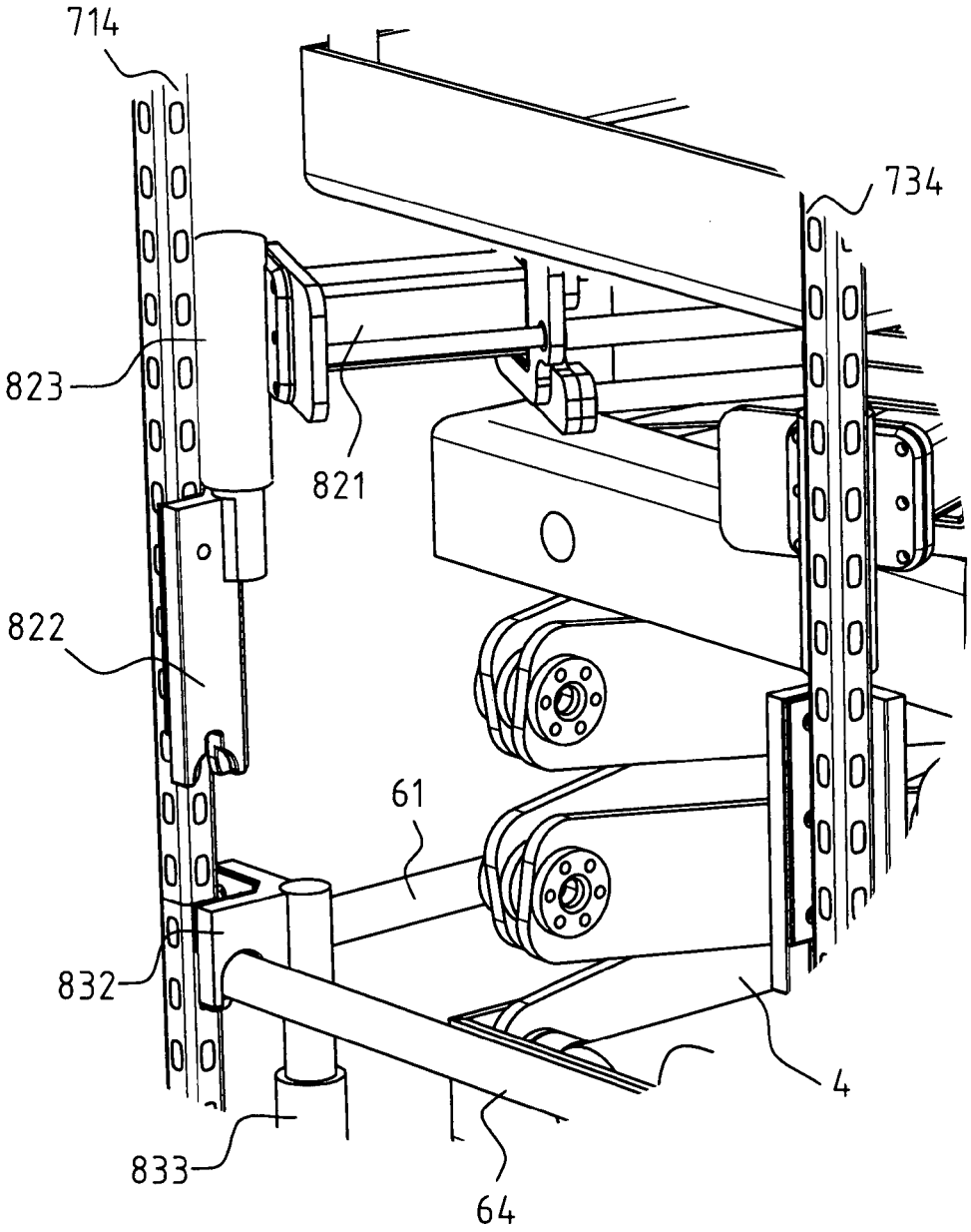
FIGS. 8-11 illustrate the continuation of a method according to embodiments of the present invention wherein, once the first part/base platform has been fixed to the ledgers of level 1, the second part/the work-floor is driven upward by means of the main distance control means to a level at which attachment of the fixing means of the work-floor to the ledgers of the subsequent level above can take place.

FIG. 8 illustrates the further progress of the ascent process. In this phase of the method the base platform remains fixed at the first level of ledgers while work-floor 2 is pushed upward relative to base platform 3 by means of distance control means 4. In the first instance the distance correction means 823 and coupling structure 822 remain here at the same horizontal position, in this case adjacent to upright 714. This means that the retractable/extendable arms 821 of the work-floor first remain unchanged. In order to then avoid possible obstacles the mounting means can be displaced by retracting the retractable/extendable arm 821 (see FIG. 9), hereby moving the distance correction means 823 and coupling structure 822 of the base platform away from the upright, preferably toward the interior of the scaffold section. The position of mounting means 82 can however be changed in alternative manner such that obstacles are avoided as the work-floor is moved upward. These obstacles can particularly be protrusions of the upright or coupling pieces arranged on the upright such as ledgers or rosettes, which are avoided by temporarily positioning the mounting means at another location. FIG. 10 shows a detail of the base platform "left behind" at the first level of ledgers. Note that coupling structure 832 does not adjoin the upright (this in similar and synchronized manner for each of the four uprights of the scaffold). Further illustrated is that coupling structure 832 is coupled to a for instance cylindrical rod driven by a piston comprised in the distance correction means 833. In preferred embodiments of the present invention this cylindrical rod is rotatable in the piston round its longitudinal axis. It should be noted that the coupling of the two recesses 834 arranged on the underside of the L-structure forming the coupling structure 832 is arranged at symmetrically predetermined locations relative to the cylindrical rod, and that these recesses can provide for an "automatic" distance setting relative to the upright. This is an effect which occurs relative to one upright but which is enhanced when the four coupling structures 832 are fixed in such manner close to the four uprights so that a very safe mounting of the work-floor in the upright is created, particularly relative to the ledgers at a determined level. The cylindrical rod of the distance correction means 833 being rotatably mounted along its longitudinal axis can further ensure that an automatic rotation of coupling structure 832 takes place, so that coupling to the ledgers can be obtained when the recesses are initially not perfectly aligned with the respective ledgers. This effect allows this lifting unit to be used for different dimensions of scaffold sections. The pivotal mounting of the retractable/extendable arms 831 of the base platform also allows the dimensions of the base platform to be adapted as a function of the scaffold section size. A combined action of a pivoting movement and extending/retracting the respective arms 831 of the base platform and the automatic rotation of the distance correction means 832 thus allows a simple adjustment for different sizes of scaffold section.

It should be noted that the same features apply mutatis mutandis for the mounting means 82 of the work-floor.

Figure 9:
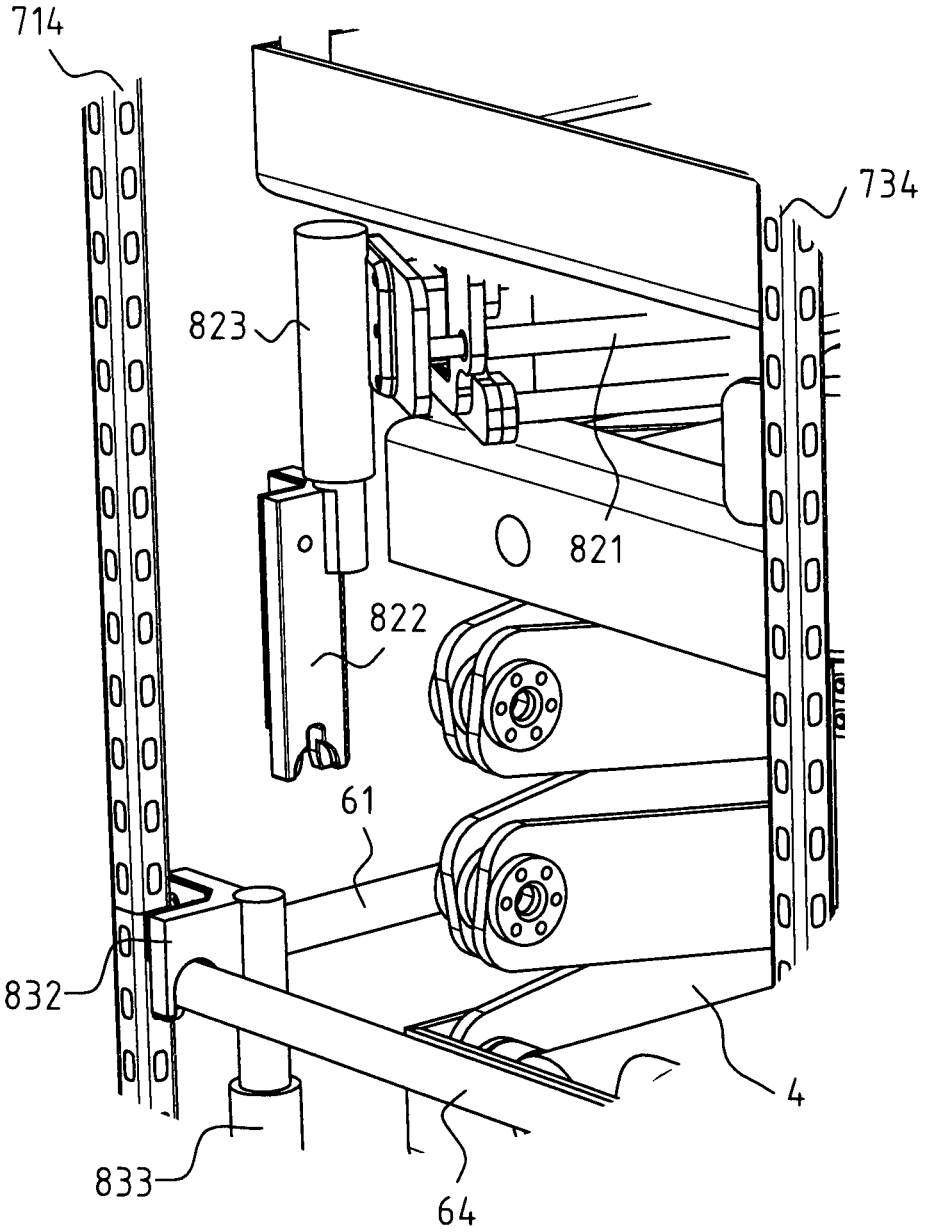
Figure 10:
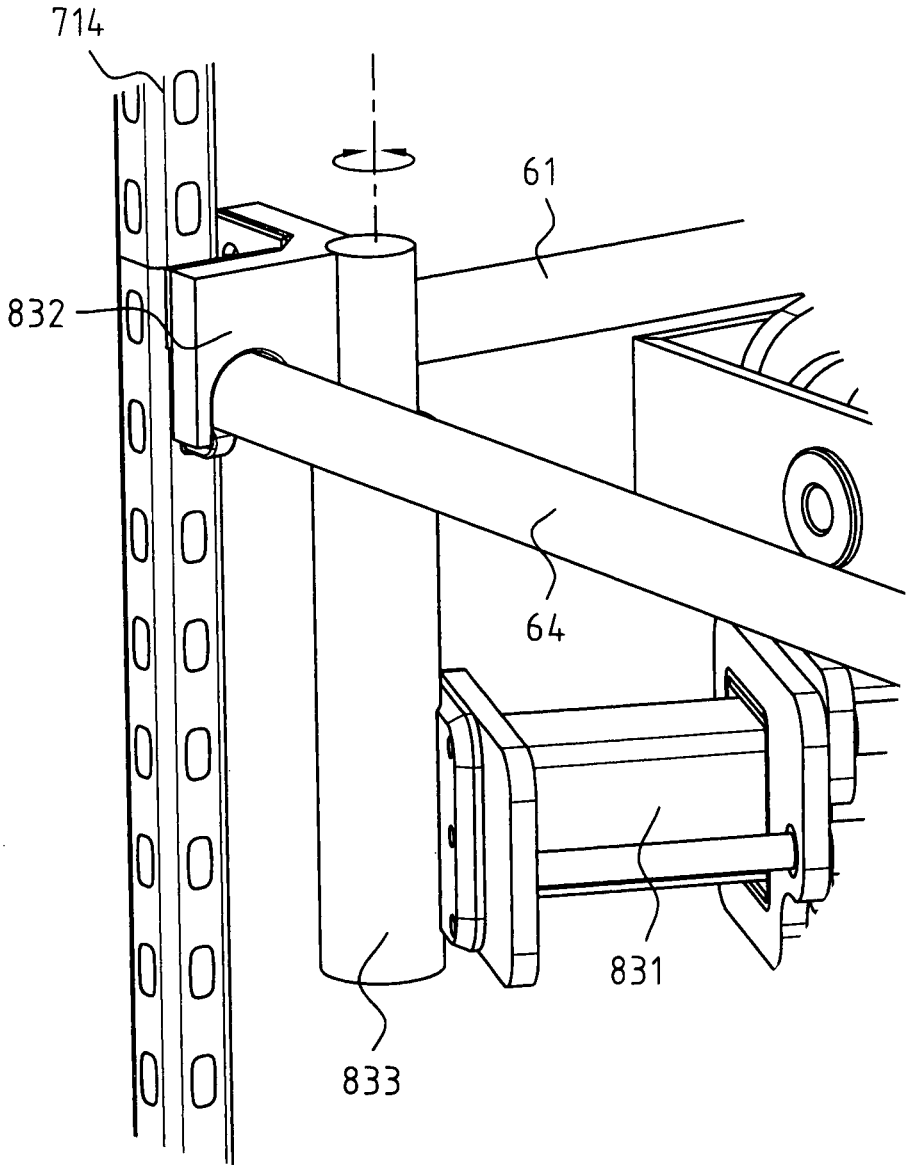
Figure 11:
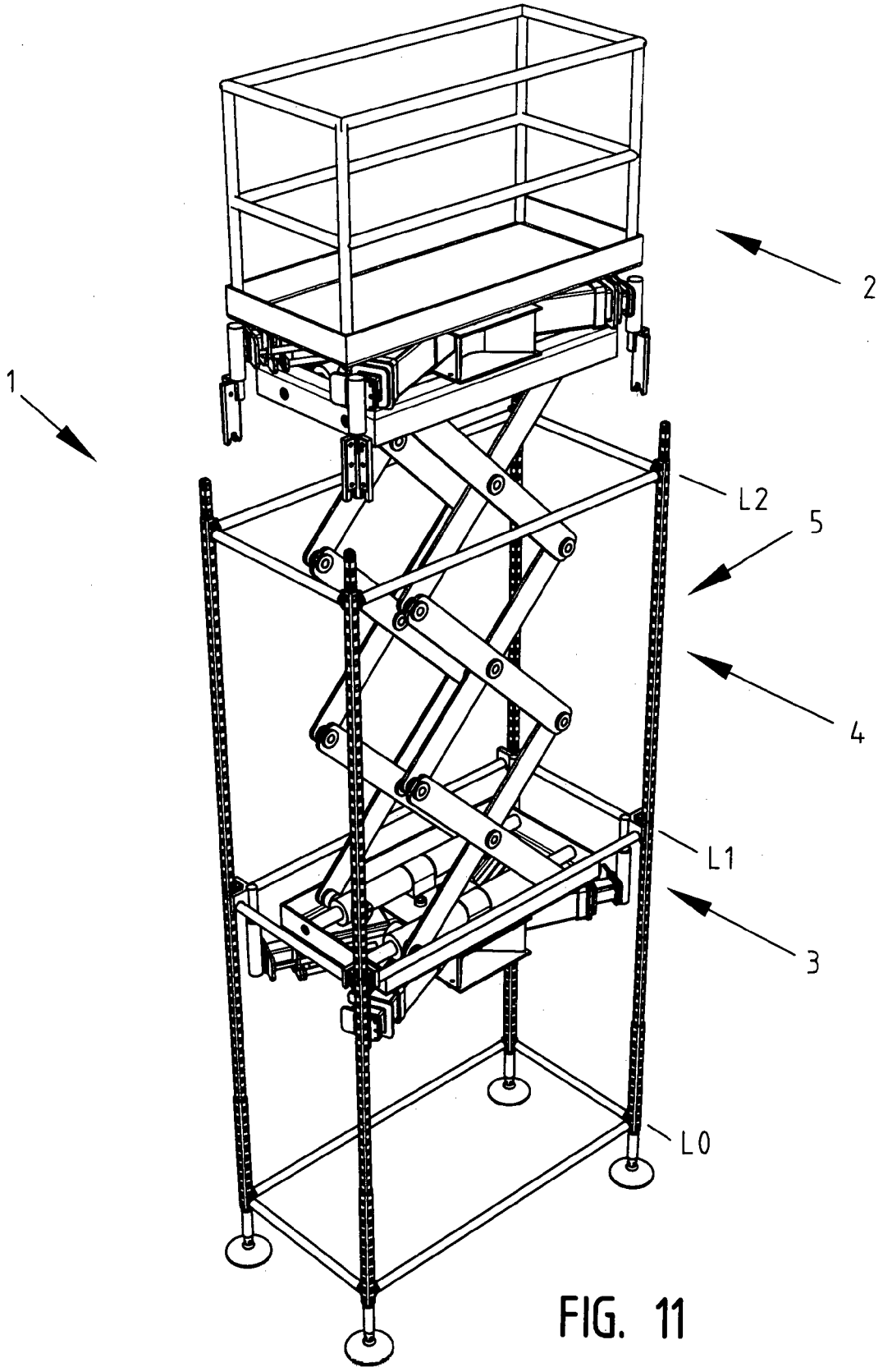

FIG. 11 shows the final result of the action illustrated in FIGS. 9 and 10, wherein the work-floor/the second part is pushed upward relative to the fixed base platform/first part 3 by the main distance control means 4 without encountering any obstacles here, in particular the ledgers of the subsequent (for instance second) ledger level.

In this phase of the method according to embodiments of the present invention the extendable arms 821 of the base platform can be extended once again such that coupling structures 822 can once again couple to ledgers 6 close to the corners of the scaffold sections defined by uprights 7. This process is not shown explicitly, but results once again in the phase shown in FIG. 1, be it at the subsequent (second) level, and wherein base platform 3 is further still fixed at the previous level of ledgers (for instance the first level).

Figure 12A:
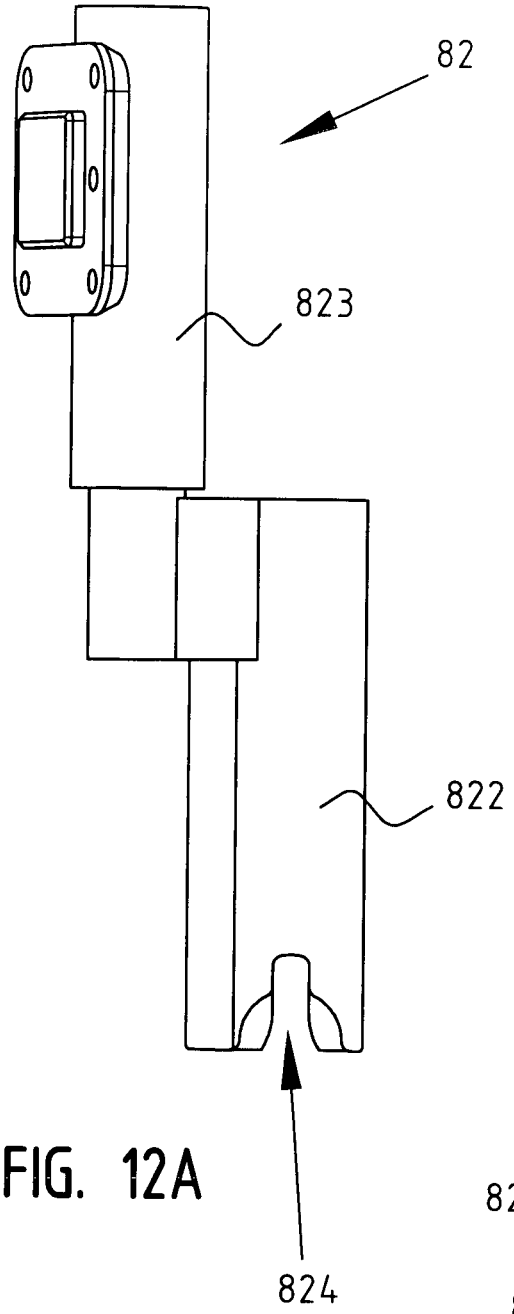
FIG. 12 illustrates an embodiment of a coupling structure of (the fixing means) of the work-floor.
Figure 12B:
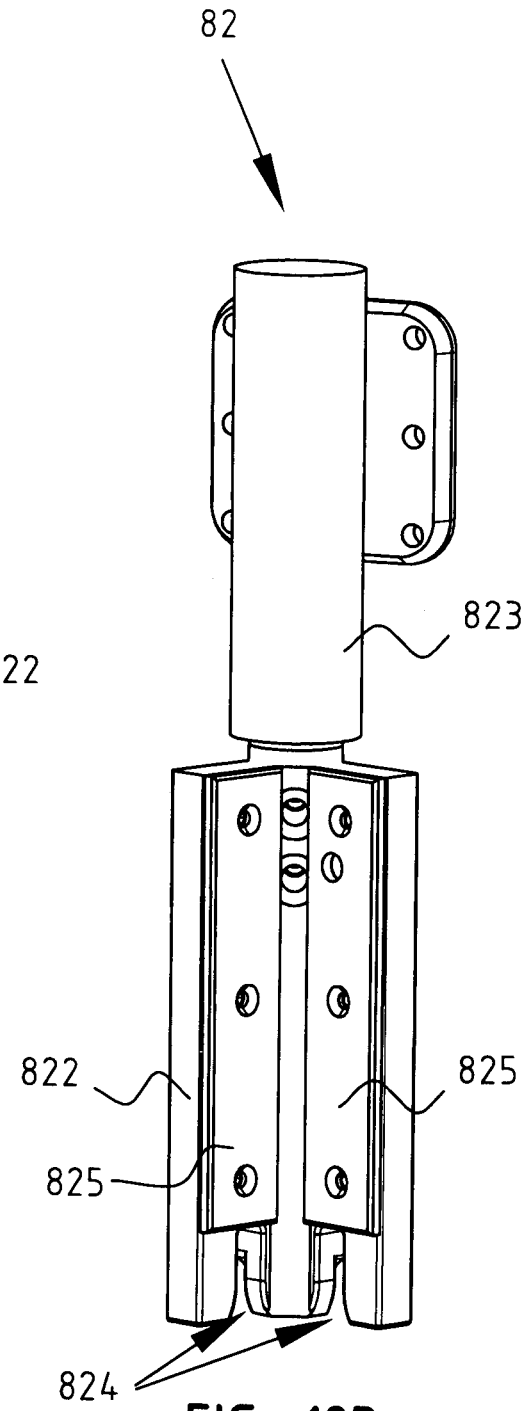

FIGS. 12A and 12B show a detail view of a part of mounting means 82 of the work-floor/the second part (the arm is not shown). A distance correction means 823, which is adapted to be connected to arm 821, is further connected to a rod-like element which can slide in and out in driven manner. The rod-like element comprises on its other outer end a coupling structure 822 comprising recesses 824 which are adapted to engage over (coupling structures of) the ledgers. A lubricant 825 is applied to the internal wall of the coupling structure in order to facilitate the movement along the upright. The coupling structure can be a substantially L-shaped element wherein the two recesses 824 are arranged on the underside of the two respective legs of the L. The legs of the L are preferably of equal length.

Figure 13:
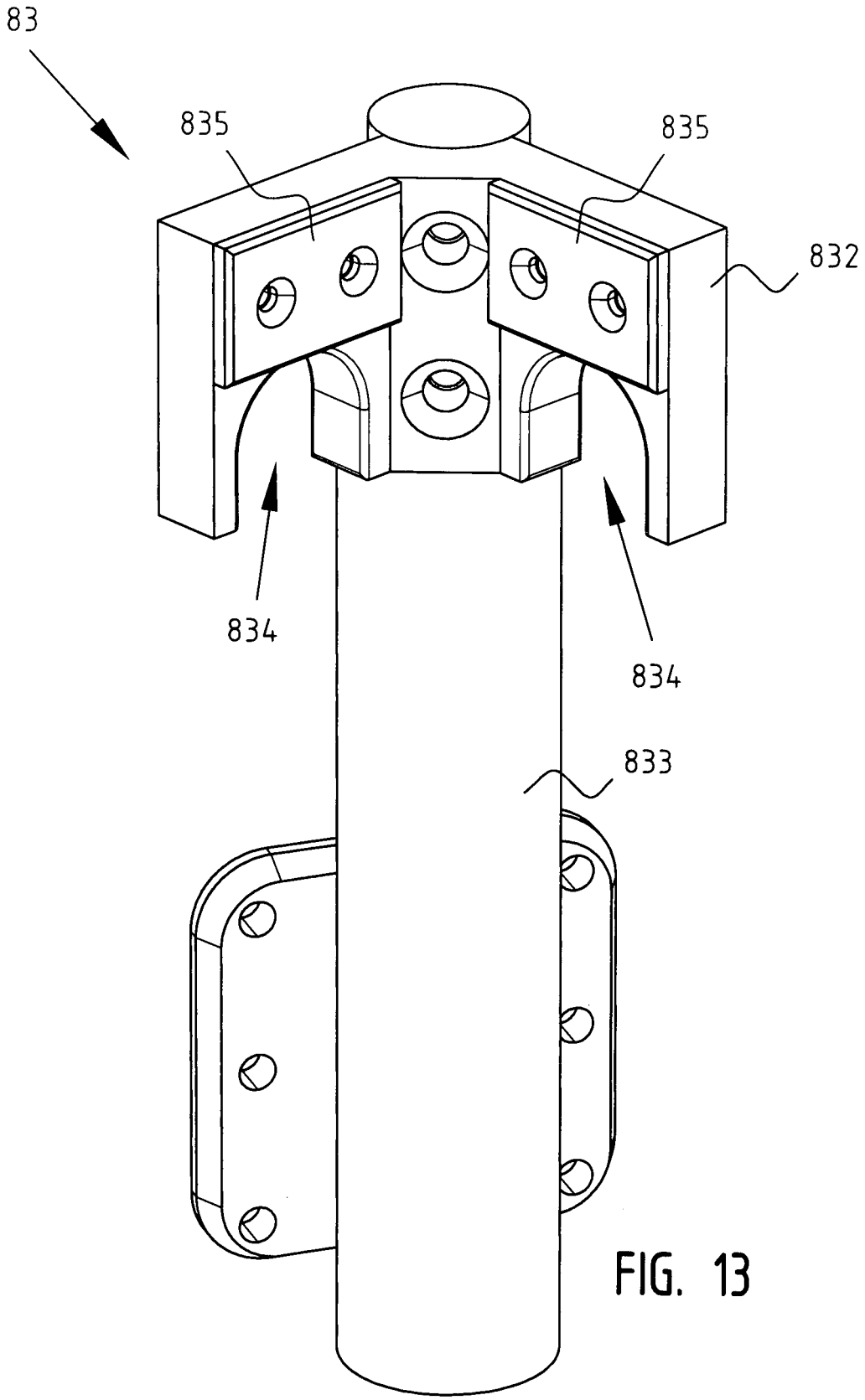
FIG. 13 illustrates an embodiment of a coupling structure of (the fixing means) of the base platform.

FIG. 13 shows a detail view of a part of mounting means 83 of the base platform/the first part (the arm is not shown). A distance correction means 833, which is adapted to be connected to arm 831, is further connected to a rod-like element which can slide in and out in driven manner. The rod-like element comprises on its other outer end a coupling structure 832 comprising recesses 834 which are adapted to engage over (coupling structures of) the ledgers. A lubricant 835 is applied to the internal wall of the coupling structure in order to facilitate the movement of the work-floor along the coupling structure. The coupling structure can be a substantially L-shaped element wherein the two recesses 834 are arranged on the underside of the two respective legs of the L. The legs of the L are preferably of equal length.

The method can then be repeated in order to ascend further with the lift unit to a higher level by once again pulling base platform 3 upward by means of the main distance control means 4 to the next (in this case third) ledger level, a phase corresponding to the phase shown in FIG. 1.

The retractable/extendable arms 831 and 821 comprised in the respective mounting means 83 and 82 can consist of a number of (for instance two, three, four) different parts slidable into and out of each other. This sliding in and out of the arms can for instance be driven hydraulically. In preferred embodiments the retracting/extending of the arms of the work-floor or base platform takes place simultaneously (synchronously) and in the same way, this for instance for reasons of balance, hydraulic reasons or because the four different arms of respectively the base platform or the work-floor preferably have substantially the same load-bearing properties when they are mounted on the ledgers.

Figure 14:
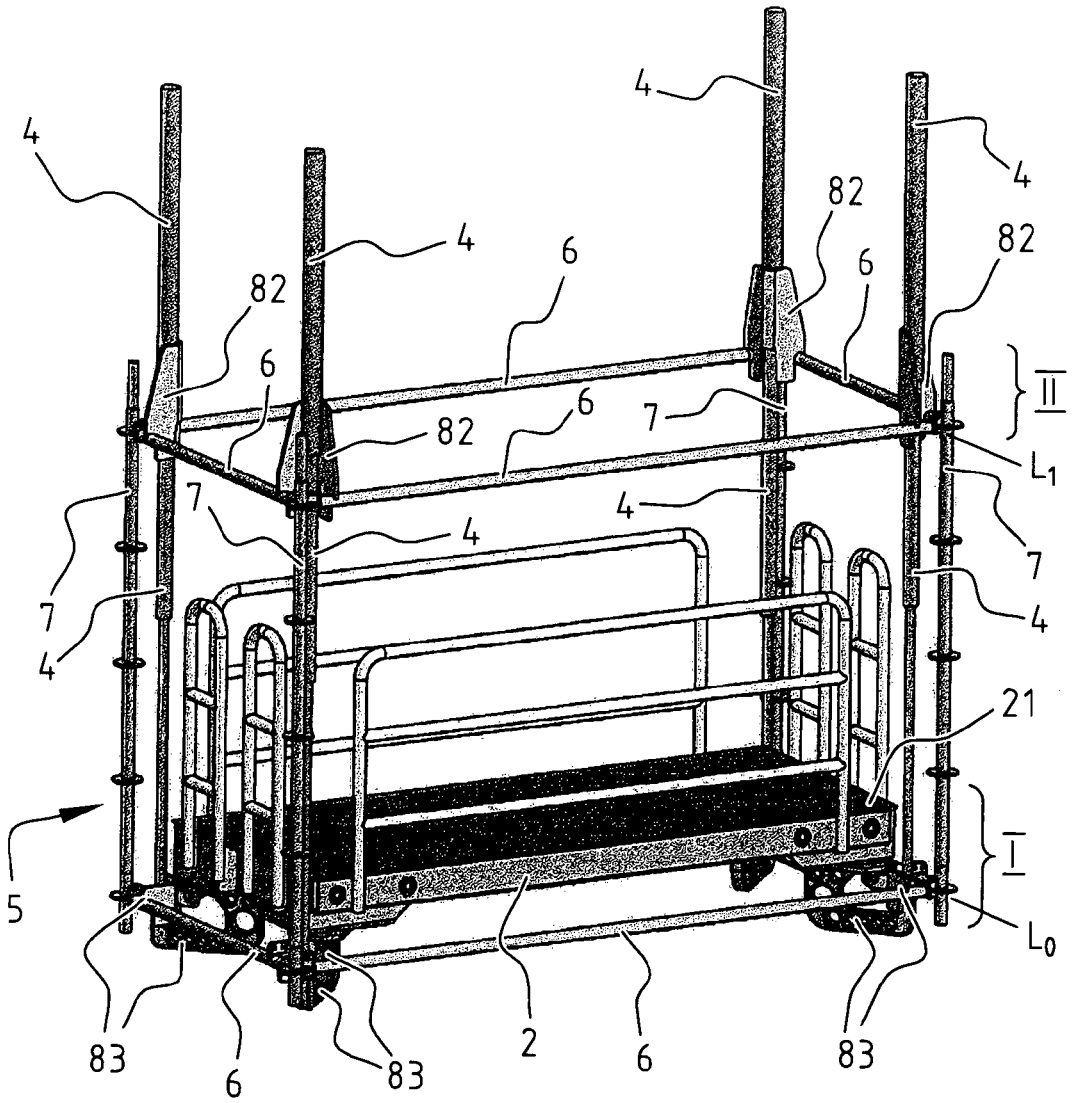
FIGS. 14 to 18 illustrate a simpler embodiment of the present invention.

FIGS. 14-18 illustrate a second example of a lift unit and its operation. This lift unit is of simpler construction. The operation thereof is further illustrated in scaffolding material of the Layher™ type. In contrast to the lift unit of the first example, the second part (II) of this lift unit does not comprise a work-floor. The work-floor is comprised in the first part (I) of the lift unit. The first part comprises a first set of fixing means 83 which are adapted for fixing/coupling to the ledgers of the same scaffold section, for instance the ledgers of level $L_0$. These fixing means 83 here comprise a number of claws similar to the claws of the first example, although these claws are here connected to the first part for rotation about a rotation point such that the claws can pivot away around this rotation point. Each of these rotation points is arranged here close to the four corners of the first part or of the lift unit. Instead of a work-floor forming part of the second part, which was the case in the first example, the second part does not here comprise a work-floor. The second part here comprises a second set of fixing means 82 which are adapted for coupling to or for mounting at or on the ledgers at a higher level, for instance level $L_1$. The second part, here consisting substantially of the second set of fixing means 82, is connected to first part 1 by means of four cylinders arranged between the first part and the second part, this preferably close to the corners of the scaffold section in order to leave the work-floor as clear as possible. The cylinders are preferably placed vertically here along the uprights 7 defining the scaffold sections, and by being retracted or extended can vary the distance between the first and second parts, whereby an ascending movement can be obtained similar to the ascending movement elucidated for the first example. These cylinders can for instance be driven hydraulically or pneumatically. These cylinders are an advantageous alternative to the scissor connection as described for the first embodiment. In alternative embodiments it is also possible to opt for other distance control means, as will be appreciated by the skilled person. Work-floor 2 can further also be provided with railings. The placing of these railings is preferably such that, during an upward ascending movement of the lift unit in the scaffold, these railings are not obstructed by elements of the lift unit and/or scaffold. FIG. 14 shows the situation of the lift unit wherein the second set of fixing means is coupled to ledgers at level $L_1$ of a scaffold of the Layher™ type. At the bottom the fixing means of the first part are still coupled to the ledgers at the lower level $L_0$. FIGS. 15-18 illustrate an ascending movement of such a lift unit in a scaffold, this being similar to the process illustrated for the lift unit of the first example.

Figure 15:
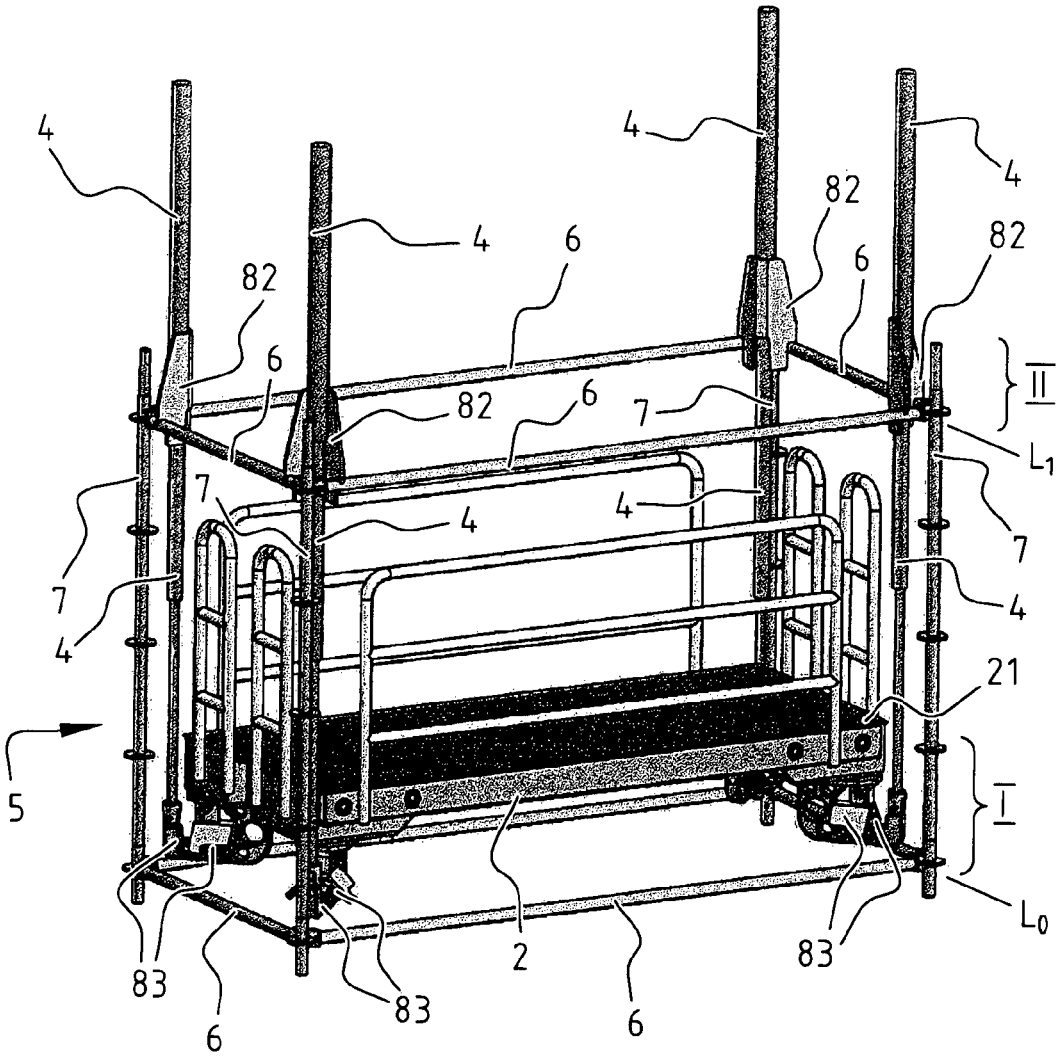
Figure 16:
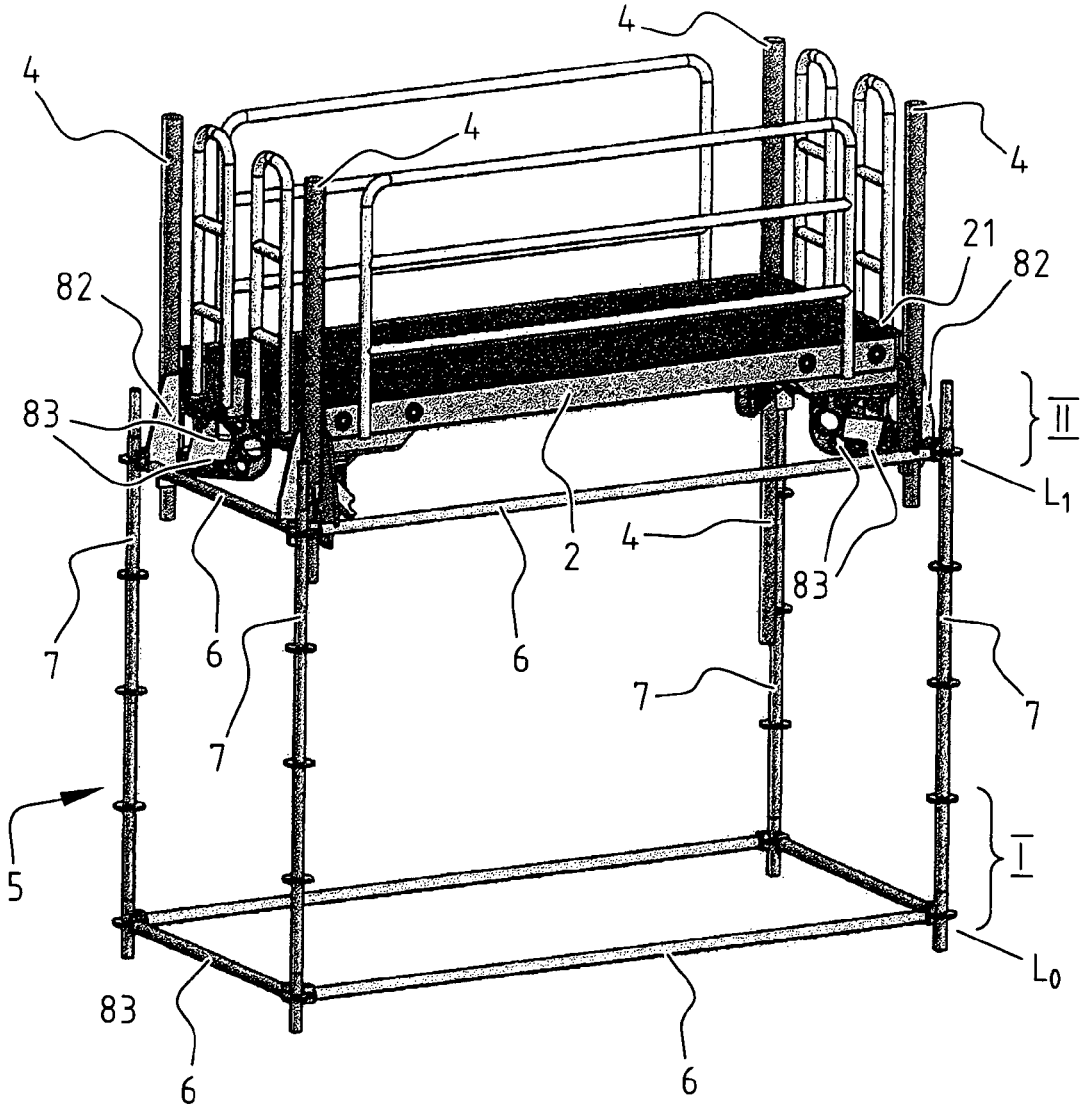
Figure 17:
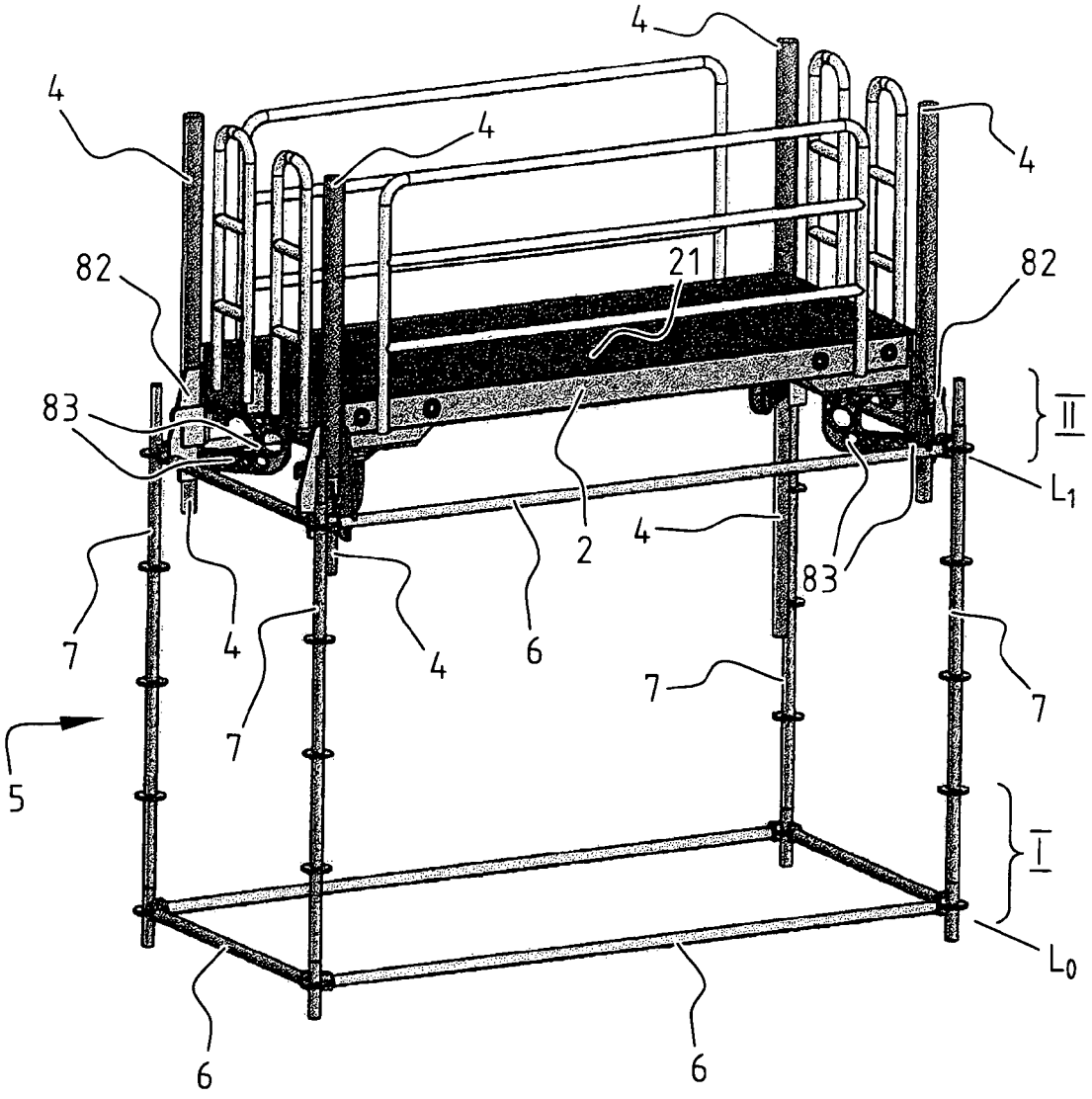
Figure 18:
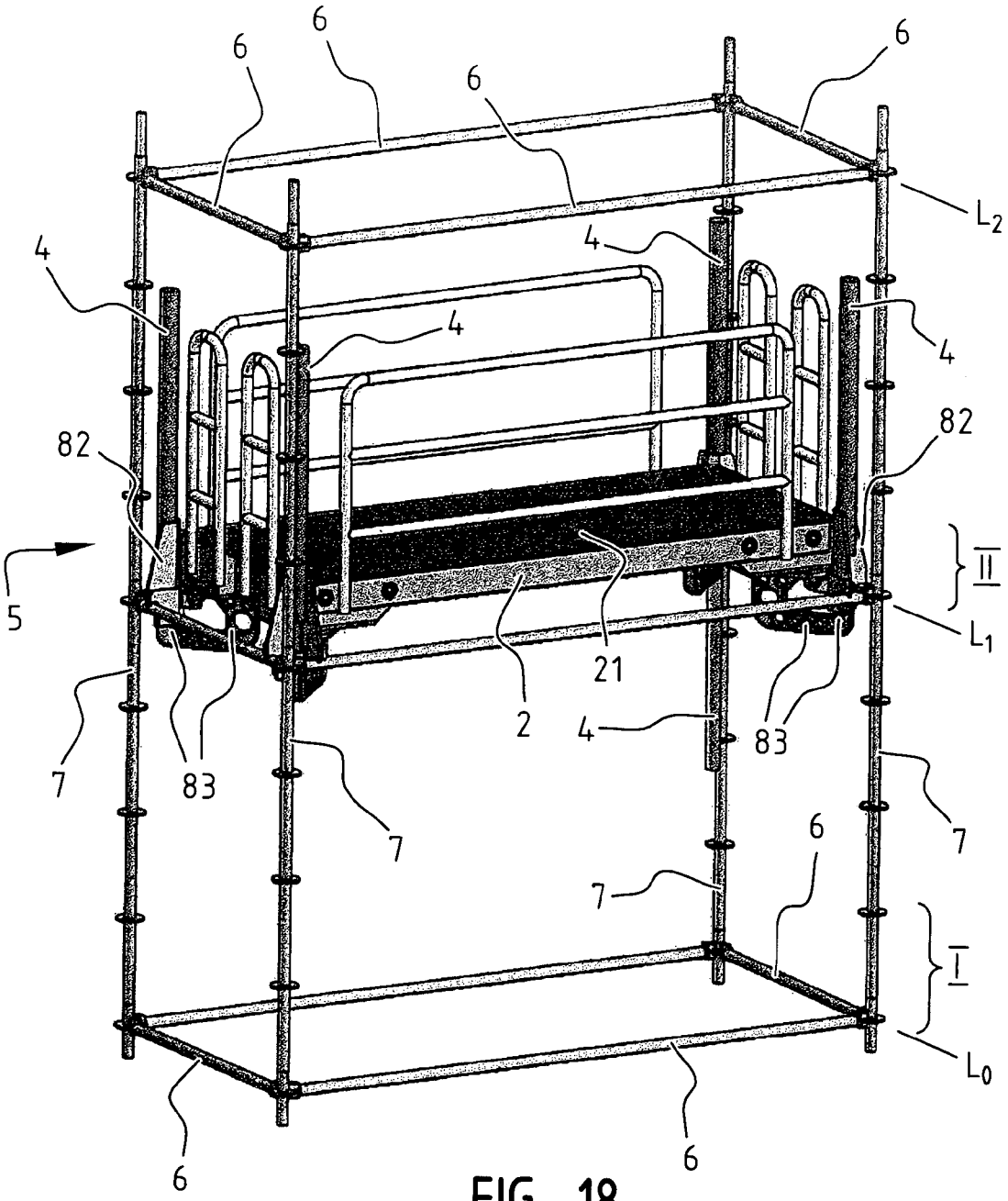

In FIG. 15 the coupling means of fixing means 83 have been pivoted away round their respective rotation points such that the first part of the lift unit moves clear of the ledger level $L_0$. In this situation the lift unit hangs from the ledgers at level $L_1$ to which it is coupled by means of the second set of fixing means 82. The distance control means consisting of four extendable cylinders can at this moment pull the first part upward, resulting in the situation as shown in FIG. 16. Here the fixing means 83 of the first part are situated close to fixing means 82 of the second part. The fixing means of second part 82 are still coupled to the ledgers at level $L_1$ of the scaffold. The first set of fixing means 83 can now be rotated back round the rotation point such that they are brought into a position from which they can be coupled to the ledgers at the first level $L_1$ by lowering the first part again to some extent. The fixing means of the first and the second part do not obstruct each other here (FIG. 17, FIG. 18).

Note that it is not always necessary for the ascending movement to comprise a "lifting-in" movement. This depends for instance on the fixing means used and/or the coupling structure thereof.

At this moment the fixing means of the first part 83 are mounted on/coupled to the ledgers at level $L_1$ and the scaffold can be erected further upward by arranging uprights 7 in the corners and connecting them to a new level $L_2$ of ledgers 6. In this situation the distance control means 4 can once again move the second set of fixing means upward in the direction of the ledgers at the second level $L_2$, and fixing means 82 of the second part can again be coupled to ledgers at the subsequent level $L_2$, whereby we arrive once again in the situation illustrated in FIG. 14, albeit in a higher section of the scaffold. Fixing means 82 of the second set are adapted to rotate away around the longitudinal axis of the spacing means, here cylinders, in order to avoid obstacles here during the ascending movement (see for instance FIG. 19).

Figure 26:
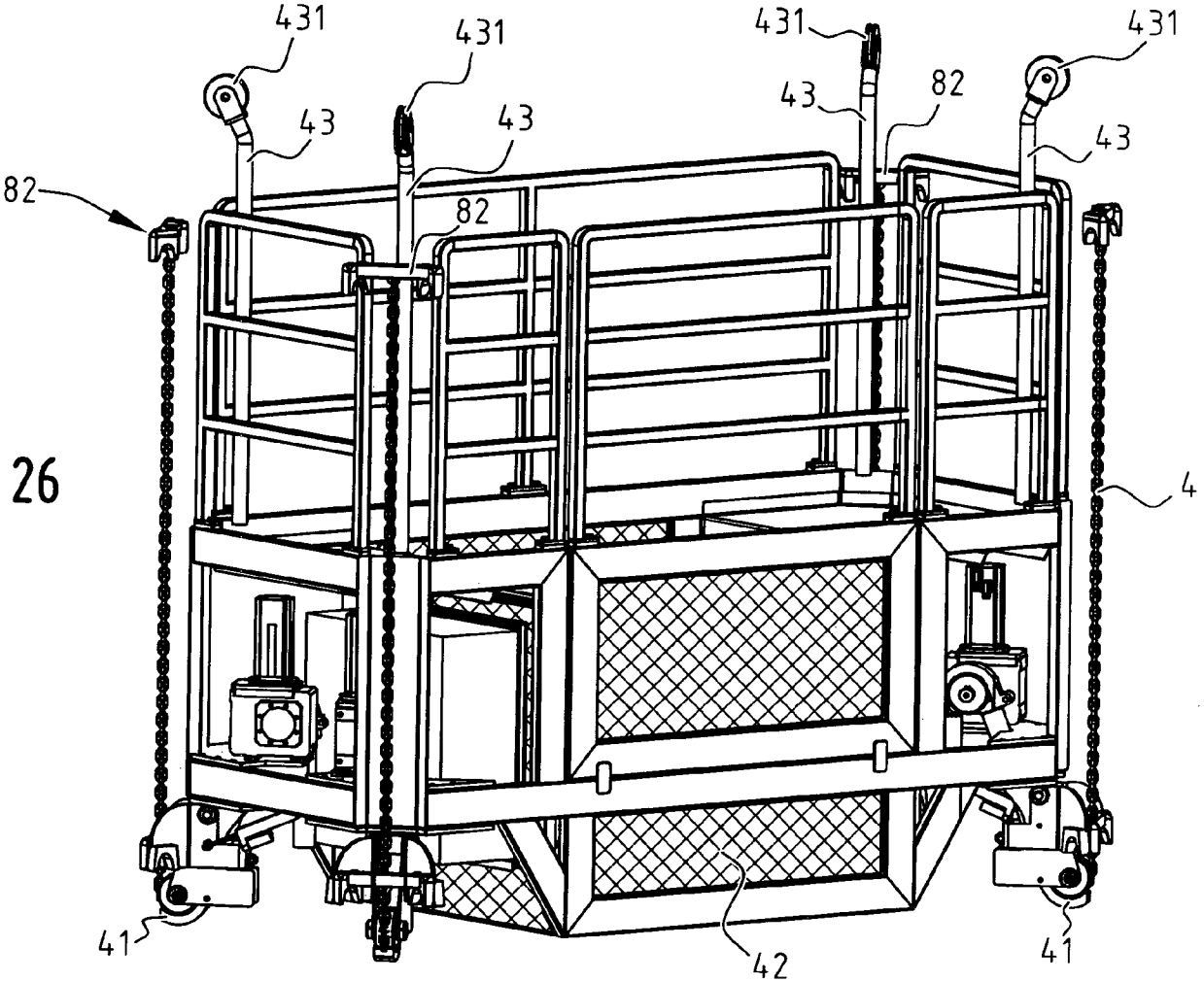
FIG. 26 is a perspective view of an embodiment according to the first aspect of the present invention.

An alternative embodiment of the first aspect of the present invention is described in FIG. 26.

This climbing lift generally corresponds to the climbing lift described with reference to FIGS. 14 to 18. The first set of fixing means is similar to the set described with reference to FIGS. 14 to 18. The second set of fixing means is formed here however by a set of four claws 82 (shown in more detail in FIG. 25), which are connected to four corresponding chains or cables and thereby form the spacing means 4. The second set of fixing means preferably has to be displaced here by the user in order to make the ascending movement possible. The other outer ends of the respective chains or cables can be connected to a drivable wind-up mechanism 42 comprised in the climbing lift, for instance in a space adapted for this purpose under the work-floor. The chains or cables can be trained from this space to the vertical positions on the outer side of the climbing lift using associated guide wheels 41. Such guide wheels 41 are preferably situated on the outer side of the four corners of the climbing lift. A workman/user present on the climbing lift can, when the first set of fixing means is coupled to an underlying level of ledgers, move the different spacing means, being the chains with respective claws, to the next higher level of ledgers and can couple the claws to the ledgers of this ledger level. Once the coupling has been realized, the first set of fixing means can be uncoupled again, pulled upward by means of spacing means 4 and be coupled to the next level above, after which the climbing process can be repeated. Descending proceeds in accordance with a similar process.

Claws 82 are shown in more detail in FIG. 25. The upper figures show side views, while the figure at bottom left shows a bottom view and the figure at bottom right shows a perspective view of a claw according to a preferred embodiment. Claw 82 comprises a connecting part 82V comprising two recesses 824 which are adapted to each simultaneously receive one of two adjacent lengthwise and width ledgers defining a section. A stable and firm connection is made in such manner to the ledgers close to the respective uprights of the scaffold. The claws preferably also comprise a connecting part 82R which is adapted for connection to a chain link. This connecting part can for instance comprise a ring mounted on connecting part 82V, or can for instance be an opening in the connecting part.

The climbing lift can have a substantially rectangular form in top view. Close to or at each of the corners the climbing lift can further be provided with a support means, such as for instance a vertical support 43. Such a support means is preferably adapted to still hold the claws at height relative to the workman controlling the climbing lift after release, in other words to ensure that the claws do not drop back or are wound up to a height which results in the workman having to bend in order to grasp the claws. Such supports are preferably placed vertically close to the corners of the climbing lifts and can comprise on their upper outer end a guide wheel 31 over which the chain can be trained. In preferred embodiments a counterweight or other force compensation means, such as for instance a suitable spring (not shown), can further be used in order to ensure that the claw, which is attached to the chain and the chain of which is suspended over the respective guide wheel, remains at a stable height.

The lifts according to embodiments of the first aspect of the present invention can preferably be used for the erection or dismantling of scaffolding constructions. The lift unit can thus be carried to a highest level of an existing scaffold (possibly the ground level), wherein the lift unit is loaded with scaffolding material to enable further erection of the scaffold, after which a subsequent scaffold section and a subsequent level of the scaffold can be erected by the operative present on a work-floor. This operative can be a person, but can also be a robot arm positioned and programmed in appropriate manner to bring about the erection of the scaffold in automatic manner. Once the subsequent scaffold section has been erected, the lift unit can ascend to the next level of ledgers and a further section can be constructed, and so on.

During dismantling of the scaffold the lift unit (in particular the work-floor) can be fixed at the highest ledger level but one of the scaffold so that an operative can dismantle the ledgers and uprights of the surrounding uppermost scaffold section and store them on a work-floor. The lift unit can then descend once again to the scaffold section below, which has now become the uppermost section, so as to also dismantle this scaffold section and store the scaffolding material on the work-floor of the lift. A whole scaffold column can in this way be easily dismantled.

In determined embodiments it may be desirable for the usable surface/upper surface of the available work-floor to connect closely to the uprights and ledgers of the scaffold. A larger such surface can thus provide for a greater load capacity. In preferred embodiments this surface can be separated all around from the scaffolding structure by a distance of about 10 cm. Embodiments of the present invention can accordingly further comprise guide means (not shown) arranged at or on the coupling structures of (the fixing means of) the work-floor and/or at or on the coupling structures of (the fixing means of) the base platform in order to guide the movement of these coupling structures along the uprights of the scaffold. These guide means can for instance comprise guide wheels which in use rest at least temporarily against the uprights of the scaffold during the downward or upward movement of work-floor and/or base platform. The resistance to swing of the lift unit in the scaffold can in this way be increased.

It should be noted that the distance control means as described in determined embodiments of the present invention can comprise not only a main distance control means (for instance distance control means of the scissor lift type), but optionally also distance correction means. It is through co-action of both means that the appropriate distance variation between work-floor and base platform can be achieved. A relatively small contribution can thus be made to the distance variation by making use of the distance correction means, while the greater part of the distance variation can typically be caused by the main distance control means. The skilled person will appreciate that generating small differences in distance using for instance a scissor lift without causing jolting can be carried out less easily than if this were done using other distance correction means.

It can further be noted that in determined embodiments the securing or release of the fixing means to or from the ledgers can also involve lifting in or out of the coupling structure over/away from the ledgers, and can preferably be realized with the distance correction means. This lifting in or out movement or this process can be seen as part of the fixing/uncoupling process. Note that the distance correction means are further adapted to obtain a substantially horizontal placing of the work-floor/the base platform in the scaffold by fine adjustment of the height of the four corners of the work-floor/the base platform.

Figure 19:
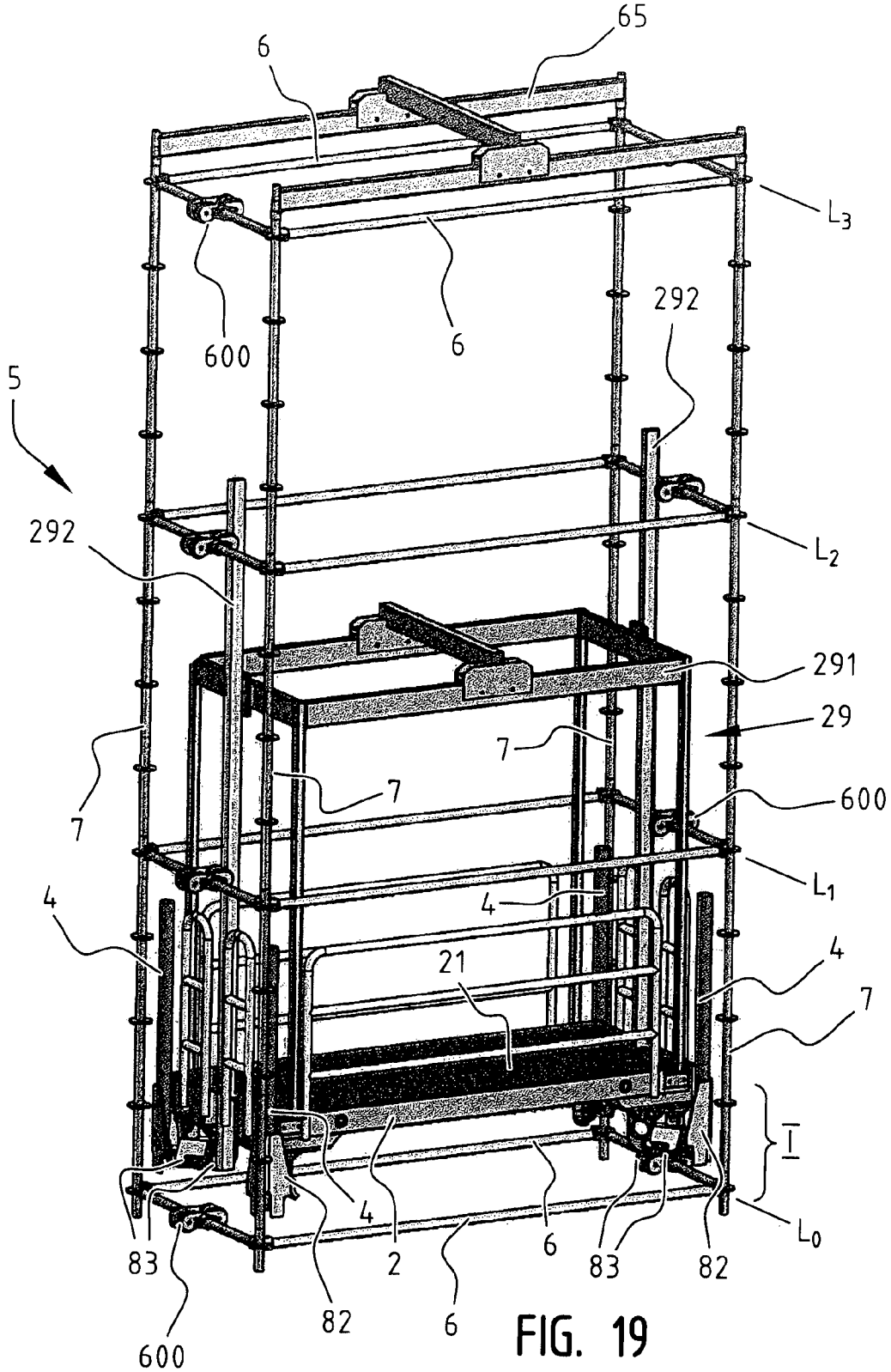
FIG. 19 illustrates an embodiment according to the sixth aspect of the present invention.
Figure 20:
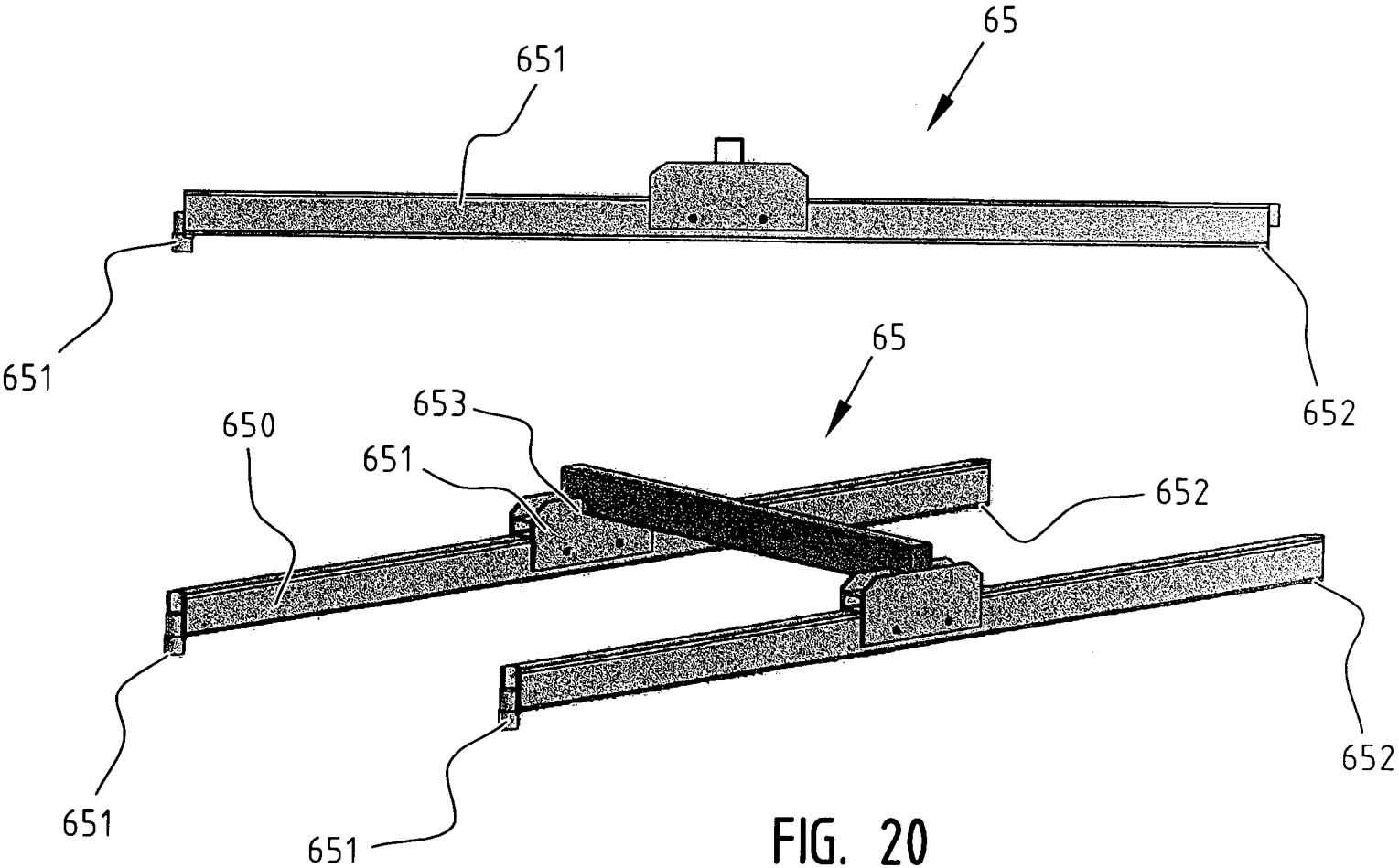
FIG. 20 shows a side view and a perspective view of a frame according to embodiments of the sixth aspect of the present invention.
Figure 21:
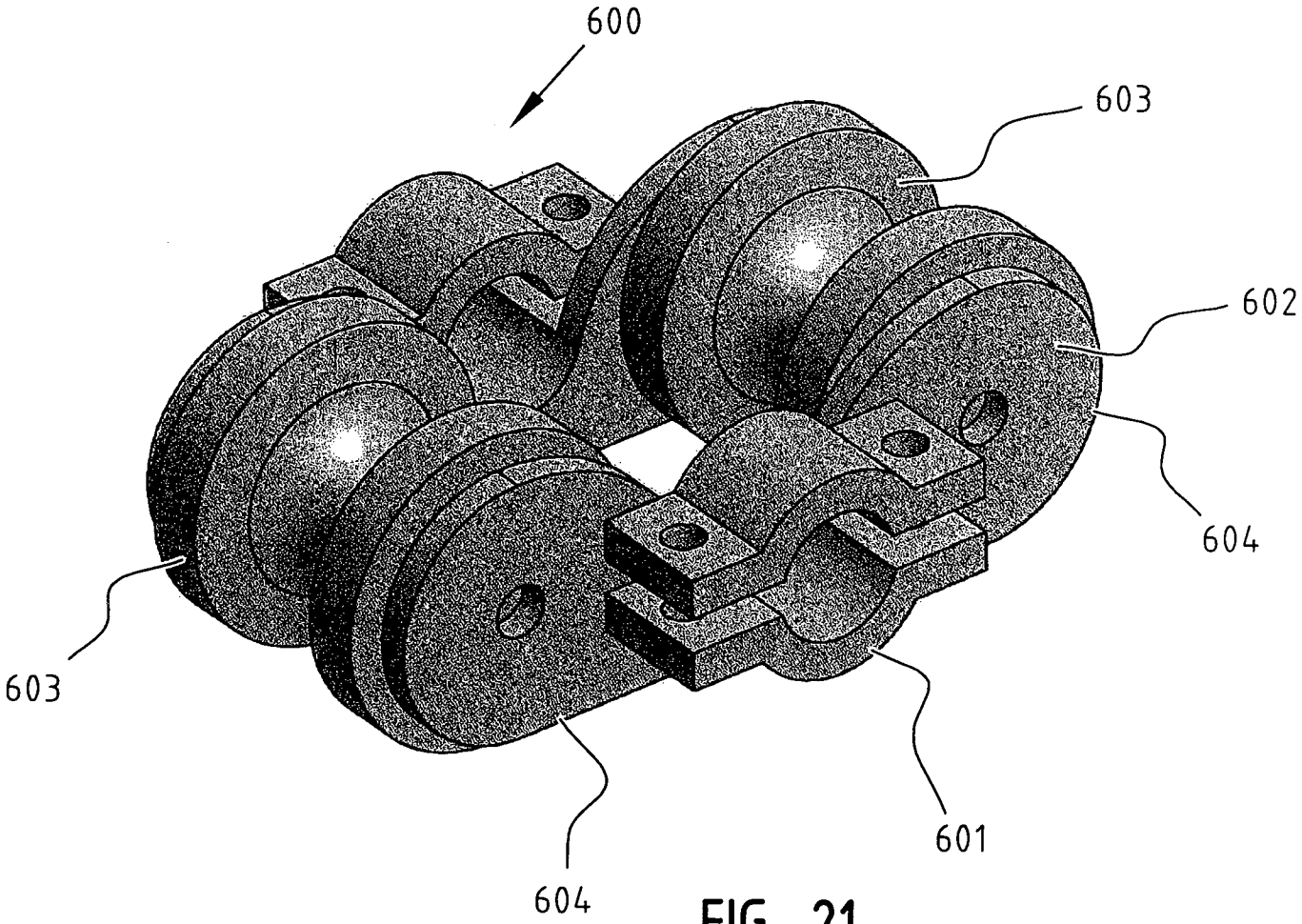
FIG. 21 shows a perspective view of a scaffold part of a guide means of a lift system according to the sixth aspect of the present invention.

FIGS. 19-21 illustrate an example of a lift system according to the sixth aspect of the present invention and its operation. FIG. 19 illustrates three scaffold sections of a scaffold column lying one above another. Used here as scaffolding material is material of the Layher™ type, although as also indicated above other types of scaffolding material can be used, as will be appreciated by the skilled person. The lift system for use in the scaffold column of the scaffold comprises a lift unit, a frame 65 which is adapted for mounting on a part of the scaffold and which is adapted to bear a hoisting means internally on the scaffold column, and a hoisting means (not shown) which is adapted at a first outer end thereof to be coupled to the frame and at a second outer end thereof to be coupled to the lift unit. The ascent or descent of the lift unit in the scaffold can be controlled by means of the hoisting means. The lift unit comprises in this case an upper frame 291 which is also adapted for coupling to the second outer end of the hoisting means. Owing to the presence of an upper frame to which the hoisting means can be coupled the user present on a work-floor 2 of the lift unit cannot be obstructed by the hoisting means. The hoisting means is for instance a hoist or a reverse hoist. A hoist typically comprises a drive mechanism connected to a chain or cable. In the case of some known hoists the mechanism can raise or lower the chain or cable in controlled manner. When pulled upward, the cable that is being raised can for instance be wound up or the chain being raised can be gathered into a chain bag. In other known hoists the mechanism itself can run over a hanging chain or cable, wherein the cable or chain remains suspended or wherein it is co-displaced during the upward movement of the mechanism over the cable or the chain. The advantage of using a reverse hoist is that the user can intervene more quickly in the case of possible problems with the hoisting means, since the drive mechanism can remain in the vicinity of the user. In alternative embodiments the upper frame 291, instead of itself being adapted for coupling to the hoisting means, can rather comprise a guide means for the cable of the hoisting means. The guide means can for instance comprise an opening arranged in a transverse beam forming part of the upper frame of the lift unit. In other embodiments the hoisting means can be mounted on the lift unit by running through an opening in work-floor 2 of the lift unit and being attached under the work-floor to this lift unit. In the case a reverse hoist is used, the drive mechanism can for instance be arranged under this work-floor.

The lift system further comprises guide means 292, 600 for guiding the movement of the lift unit in the scaffold column. These guide means can be arranged partially on the lift unit (lift part) and partially on the scaffold (scaffold part). The lift part and the scaffold part can then co-act in order to ensure guiding of the lift unit in the scaffold column. In the shown example the scaffold part of the guide means comprises guide wheels 600 arranged on the ledgers 6 of the scaffold. Different guide wheels 600 are arranged vertically one above another here on the ledgers lying one above another. Such guide means 600 can be arranged on the ledgers situated on opposite sides of the scaffold sections, for instance on the width ledgers, or on the lengthwise ledgers. Such scaffold parts of the guide means can also be arranged on both the lengthwise ledgers and the width ledgers.

In this example the lift unit further comprises a guide track 292 which is mounted on the lift unit and which is adapted to co-act with guide wheels 600 on the ledgers. The lift unit can be guided through the scaffold column by providing such a guide track 292 on either side of the lift unit. The length of these guide tracks, which are secured laterally and along the direction of the uprights (in substantially vertical direction) to the lift unit, is preferably longer than twice the height of a scaffold section. In such manner the guide track 292 co-acts at any given moment with two guide wheels 600 lying one above the other.

In order to enhance the stability of the lift system, these guide tracks can also be made longer, such as for instance longer than three times, four times the height of a scaffold section. Conversely, it is also possible to place additional ledgers between the standard ledger levels. This can for instance be done at half the height of a scaffold section, but also at other intermediate height. Such additional ledgers can be provided with a scaffold part of the guide means. In such cases the guide tracks on the scaffold unit can be made shorter, for instance shorter than the height of a scaffold section. The presence of such additional ledgers can also bring about an increased ability. The guide tracks and the guide wheels are preferably further adapted to co-act in a manner such that a deviation from the direction parallel to the uprights, being a deviation from the vertical direction, of guide track 292 is countered or avoided. The guide wheels and the guide tracks can for this purpose have a predetermined, mutually adapted and/or corresponding design. In this example guide tracks 292 are arranged on each of the two width directions of the lift unit (close to the left and right-hand side surfaces of the scaffold column). It is also possible for these guide tracks to be arranged on the lengthwise direction of the lift unit (close to the front and rear surfaces of the scaffold column) or along both the lengthwise direction and the width direction of the lift unit/scaffold. It is also possible for a plurality of guide tracks and associated sets of guide wheels to be arranged along the same plane of the scaffold column.

FIG. 20 further shows a side view and perspective view of frame 65. The frame comprises for instance elongate beam structures 650 adapted to be able to support the heavy load of the lift unit, one or more persons and a substantial quantity of scaffolding material. Beam 650 will therefore typically have a much greater load-bearing capacity than the typical ledgers 6.

Two such support beams 650 are for instance connected in H-shaped configuration by means of a transverse beam 652. This can for instance be arranged on top of support beams 650 by dropping into recesses 653 arranged in coupling pieces 651 connected to each of the support beams 650. It should be noted that in preferred embodiments the frame can be disassembled. It should be further noted that in preferred embodiments the support beams comprise a first coupling structure 651 at a first outer end and a different second coupling structure 652 at a second outer end. These coupling structures can preferably be not the same but complementary such that, when frames are arranged at the same level of two adjacent scaffold sections, these frames can couple/be attached simultaneously to the same uprights/ledgers (for instance to the connecting pin of the respective uprights). Coupling structures 651 and 652 can for instance comprise a bush which can fit over the connecting pin of an upright. At the one outer end the bush structure can be situated at the top, while at the other outer end it can be at the bottom so that they come to lie connecting above one another when they are coupled to an upright. An accessory, which for instance corresponds to a coupling structure 651 (for instance a separate hollow bush) but which is not connected to a frame, can be used here close to the outer end of the first frame with coupling structure 652 of a sequence of successive frames, close to the respective upright, in order to obtain a horizontal, appropriate position of the frame.

FIG. 21 further shows a scaffold part 600 of a guide means in the form of guide wheels mountable on the ledger. The shown guide wheels comprise mounting means 601 adapted for mounting on the ledgers of the scaffold, in addition to guide wheels 603 which are supported by and connected to mounting means 601 by means of a profile 602 and a shaft 604. Note that the shown double guide wheels allow the use of two lifts in adjacent scaffold sections. If such a combined use is not anticipated, a similar scaffold part of the guide means can comprise only one guide wheel 603 which is connected by means of profile 602 and a shaft 604 to mounting means 601 adapted for mounting on the ledgers.

In alternative embodiments a scaffold part of the guide means can be formed by a single guide wheel or a single disc which comprises a hole centrally through which the ledger is arranged. The guide wheel or the disc can then rotate around an axis defined by the respective ledger. The ledger can further also comprise a means to secure/hold the position of the guide wheel/the disc relative to the ledger in the lengthwise direction of the ledger. Such a ledger can then be referred to as a "wheel ledger".

Figure 24:
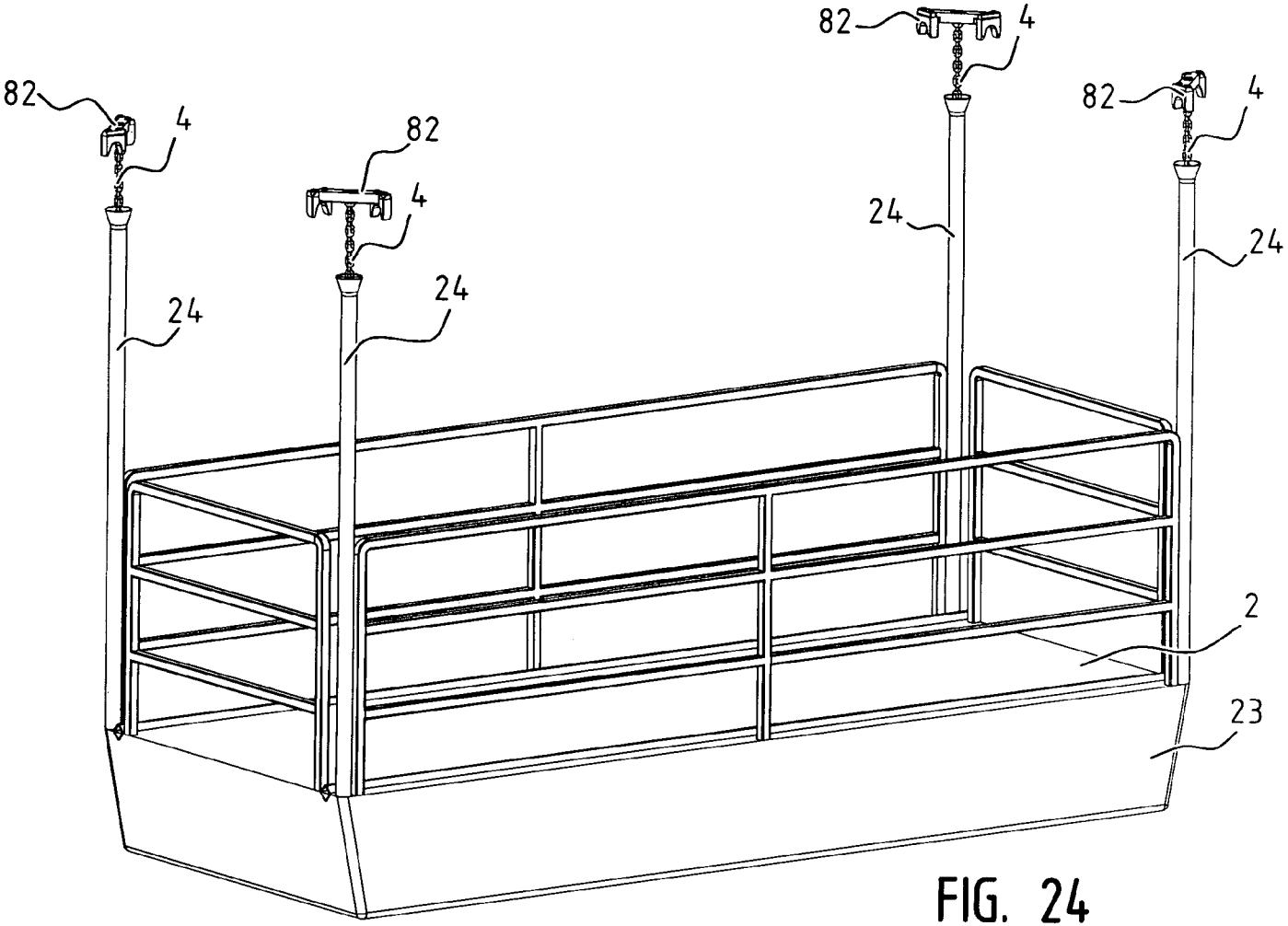
FIG. 24 is a perspective view of an embodiment of a lift system according to the sixth aspect of the present invention.
Figure 25B:
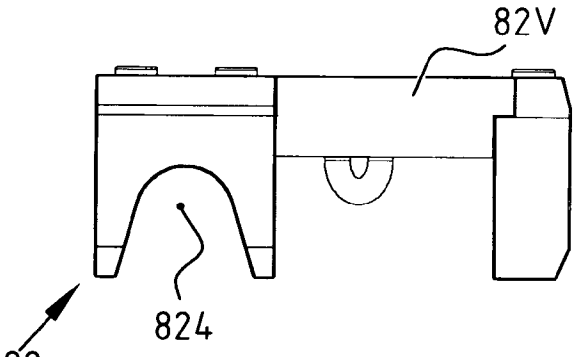
FIG. 25 shows different views of a claw as can be used in embodiments depicted in FIGS. 24 and 26.
Figure 25D:
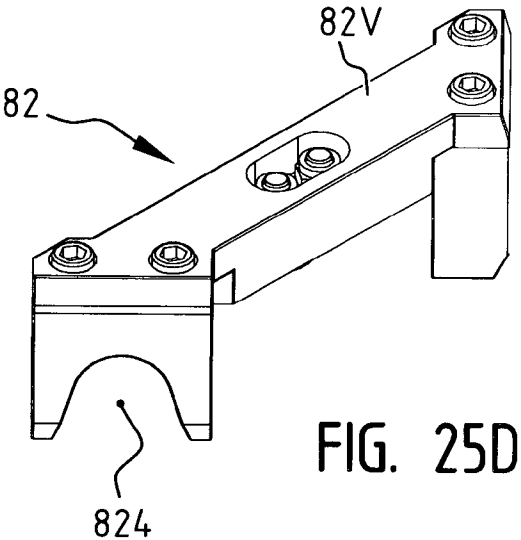
Figure 25A:
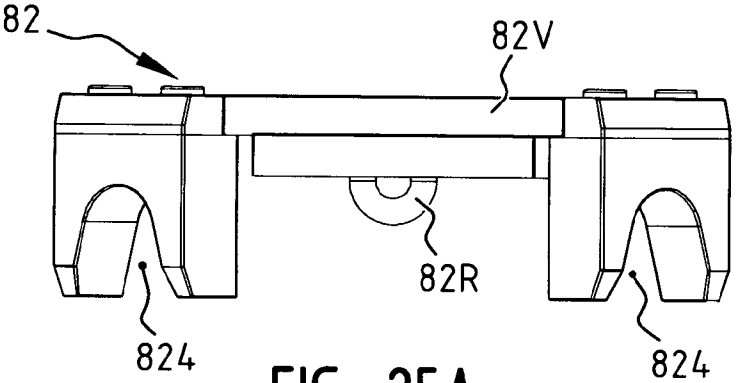
Figure 25C:
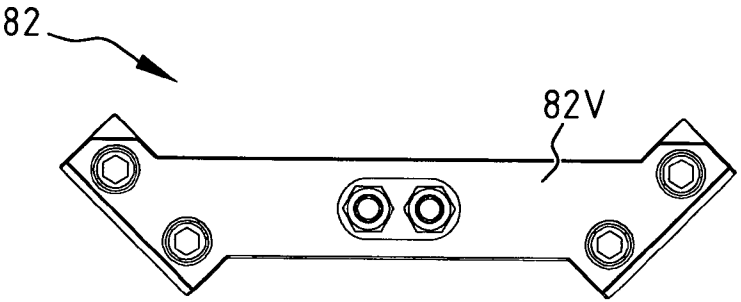

FIG. 24 shows an alternative embodiment of a lift system according to the sixth aspect of the present invention. Instead of using a frame connected by means of a hoist to a lift cage or lift unit, the lift cage comprises four chains or cables 4 connected to a set of fixing means, here for instance a set of four claws 82 (shown in more detail in FIG. 25). The other outer ends of the respective chains or cables can be connected to a drivable wind-up mechanism comprised in the lift cage, for instance in a space 23 adapted for this purpose under work-floor 2. The chains or cables can be trained from this space to the vertical positions on the outer side of the climbing lift using associated guide wheels 41. Such guide wheels 41 are preferably situated on the outer side of the four corners of the climbing lift. Each of the chains or cables is preferably also protected by means of a guard element or means arranged between each chain or cable and the space above the work-floor at the position of the movement space for a workman on the work-floor during use. Such guard elements can for instance be hollow tube parts which can also guide the respective chains or cables vertically. The guard elements can avoid an undesirable interaction between user and chain during the operation of the lift system and thus enhances safety of the system. The lift cage can also comprise at the bottom a set of chamfered side surfaces 23 or curved guide tubes which can provide for guiding of the lift cage through the successive ledger levels of a scaffold column. It should be noted that this embodiment can be implemented with or without further guiding as described above, i.e. without further vertical guide tracks on scaffold or lift, and without associated guide wheels. It should also be noted that the work-floor can also comprise rail parts compatible with a rail system in the scaffold. These rail parts can for instance guide a platform horizontally movable in the scaffold.

It is noted that the lift system shown in FIG. 19 is a lift system corresponding to a lift system as has been elucidated in the second example corresponding to the embodiment of the first aspect of the present invention.

This is not essential however, although the combined use of the two systems does provide additional advantages. The "climbing lift" of the second (or first) example according to embodiments of the first aspect of the present invention can thus be used to erect a scaffold column. When the lift unit has erected a part of the scaffold by ascending each time to a scaffold section added at the top and repeatedly erecting another scaffold section thereabove, and the scaffolding material present in the lift unit has been totally used up, frame 65 can for instance be mounted. This frame can preferably be disassembled but can also be formed integrally and mounted on top of the scaffold column. The hoisting means can be arranged between the frame and the lift unit, after which the hoist system can be used in order to cause the lift unit to ascend or descend in the shaft formed by the scaffold column. The lift unit according to the first aspect of the present invention can optionally be converted to limited extent for this purpose. This conversion can comprise of removing the spacing means and/or the first set of fixing means and/or the second set of fixing means when these take a removable form. The spacing means and/or the first set of fixing means and/or the second set of fixing means can more preferably be placed in positions such that they do not interfere with the lift system according to the sixth aspect of the present invention.

The mounting of guide wheels 600 or alternative elements on the ledgers or uprights preferably takes place in such a scenario at the moment the "climbing lift" is located in the vicinity during erection of the scaffold. Guide tracks 292 on the lift unit can be initially present on the lift unit but can also be mounted later if the "climbing lift" were to be converted to the lift system with frame and hoist according to the sixth aspect of the present invention.

When a lift unit according to the first aspect of the present invention, for instance the embodiment of the second example, forms the lift unit of the lift system according to the sixth aspect of the present invention, or is converted to a lift system according to the sixth aspect of the present invention, this lift system can be used for instance for rapid loading of new scaffolding material at a lower-lying level, for instance ground level. Fully loaded with scaffolding material, this lift can then be quickly raised, for instance hoisted, back to the upper part of the scaffold column, after which the lift system can once again be used as a lift unit according to the second example or according to the first aspect of the present invention.

In alternative embodiments the guide means on the scaffold can consist of guide tracks, and the lift part of the guide means can comprise guide wheels. In such embodiments the guide tracks must however run through the whole length of the scaffold column. Such guide tracks could be arranged along and parallel to all uprights of the scaffold column. These guide tracks can be integrated with the uprights, but can also exist separately and be adapted for coupling to different existing types of upright, such as for instance uprights of the Layher™ type. Such guide tracks can on the other hand also be arranged through the scaffold column parallel to the uprights and mounted on the ledgers.

Instead of guide wheels as scaffold part or as lift part of the guide means, other structures/elements can further be used which can provide for a substantially similar guiding. As alternative to guide wheels, guide blocks can for instance thus be arranged along the ledgers and/or uprights, or on the lift unit, which co-act respectively with the guide tracks on the lift unit or uprights/ledgers. On the contact surface adapted for coupling to the guide tracks these blocks can comprise a suitable lubricant/low-friction material.

In determined embodiments the guide means can comprise only a lift part. This lift part can for instance consist of guide tracks as described above. Such guide tracks can per se already provide a determined measure of guiding since in their vertical orientation they are restrained by the ledgers (or optional additional ledgers) during a possible lateral movement.

Figure 22:
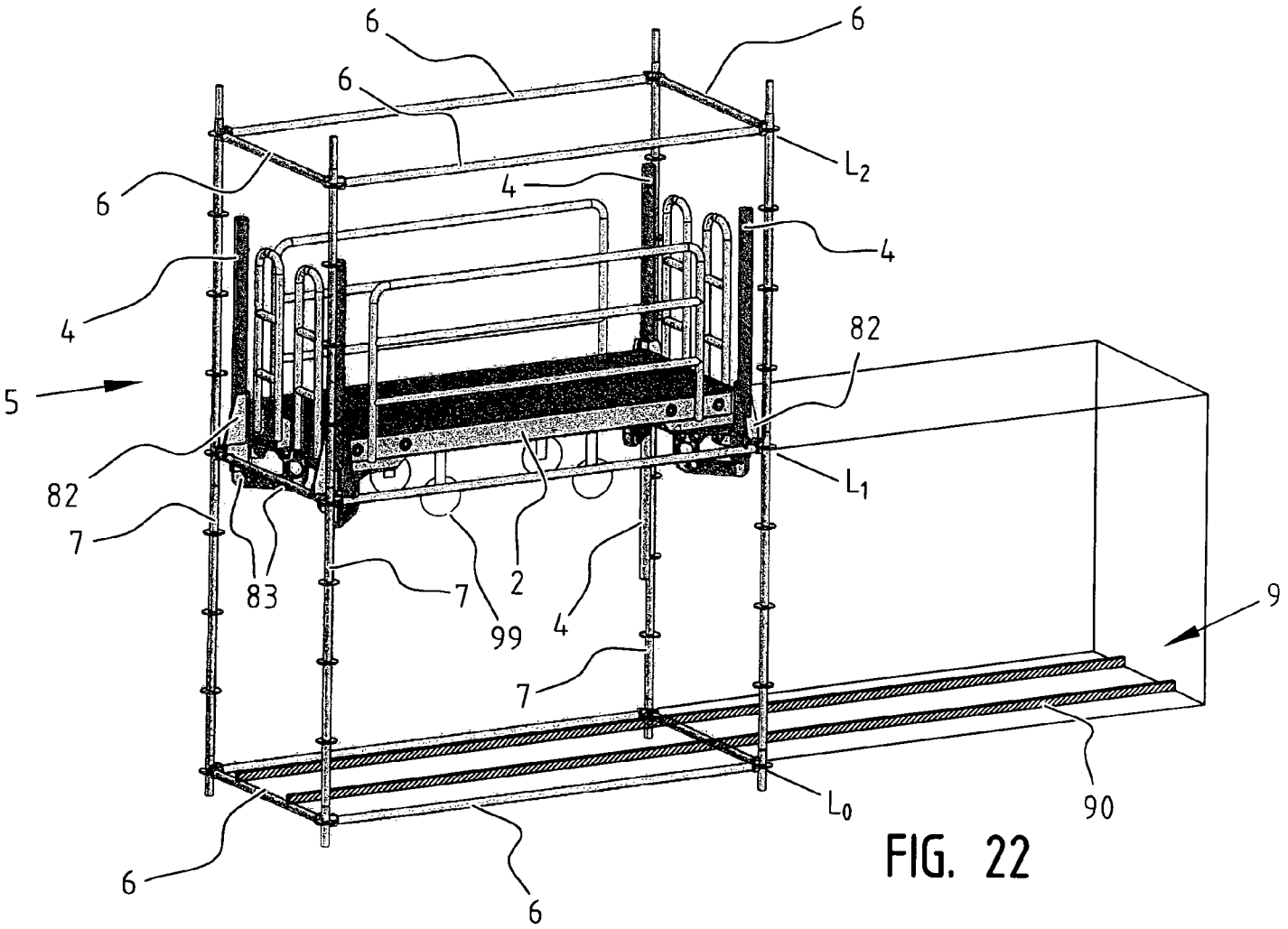
FIG. 22 shows a perspective view of a scaffold with lift unit and rail system with which a lift unit according to embodiments of the present invention can be displaced through the scaffold.
Figure 23A:
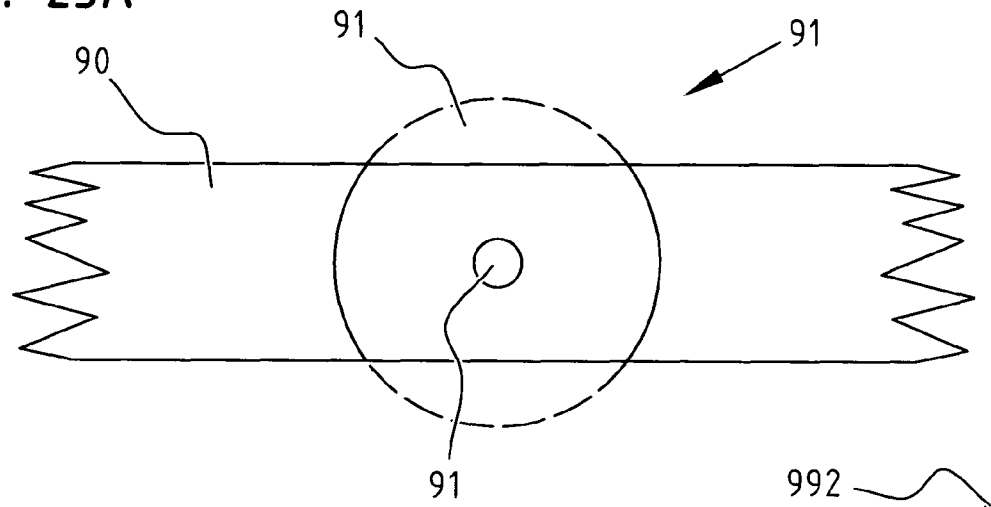
FIG. 23A is a schematic top view of a point switch for the rail system of FIG. 22.
Figure 23B:
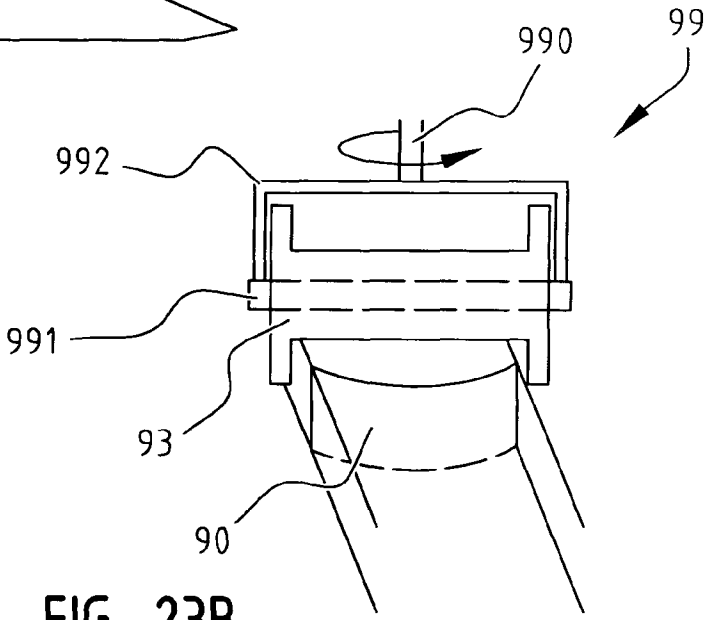
FIG. 23B is a schematic perspective view of a displacing wheel of the lift unit placed on a rail at the position of the point switch system.

It should be further noted that the lifts according to embodiments of the present invention can be provided with displacing means (see FIG. 22). The displacing means can comprise a number of (for instance four) wheel mechanisms 99 which can optionally be driven and which are adapted to move forward (for instance in order to travel) on a rail system 9 which can be arranged through the scaffolding construction at a determined ledger level (for instance ground level $L_0$). In this way this lift unit can be readily displaced via the determined level (for instance ground level $L_0$ through the whole scaffolding construction, in particular to adjacent scaffold columns. This rail system preferably comprises at least two rails 90 which are adapted for mounting on ledgers 6 of the scaffold and which are on the other hand adapted for coupling to the displacing means of the lift unit (for instance to wheels 93 of wheel mechanisms 99 of the lift unit). Rail system 9 can further be provided with point switches 91 which can for instance be manually adjusted or which can be adjusted by means of driven rotation of the wheels 93/wheel mechanisms 99 of the lift unit, which are coupled thereto, along a substantially vertical shaft 990, this rotation taking place at a location corresponding to such a point switch 91 (see FIGS. 23A and 23B). Each of the wheel mechanisms can comprise a vertical shaft 990 which is connected by means of a frame 992 to the rotation shaft 991 of a wheel 93.

These point switches 91 can comprise for instance a disc or disc part 92 which is freely rotatable about an axis 94 and which is provided with a rail part 93 compatible with the system of the rail type and is thus adapted to receive wheels 93 of the lift unit. The disc can preferably be mounted rotatably around the axis of symmetry 94 of the disc. The rail part compatible with the system of the rail type can for instance be a similar piece of rail.

Particularly when the lift unit itself does not comprise any wheel mechanisms or other displacing means, the above described rail system can further also be combined with an independent carrier unit (e.g. a carriage) which can be placed in the scaffold and which comprises the above described wheel mechanisms or other displacing means for guiding along the rail system through the scaffold, and on which the lift unit can rest.

It can further be noted that most scaffolds have dimensions of the rectangular or square type. They can thus be rectangular and have a standard length of for instance 2 or 3 meters and a standard width of for instance 1, 1.25, 1.5, 2 meters. Other dimensions are of course also possible and are therefore not precluded. The (variable) dimensions of the lift unit according to embodiments of the present invention can accordingly preferably correspond to one or more of these "standard" dimensions.

In a further aspect of the present invention two lift units or lift systems according to embodiments of the first aspect of the present invention can be arranged in two adjacent scaffold columns. In such situations the fixing means and/or guide means of both lift units or lift systems, particularly along the interface of the two scaffold columns, are preferably chosen in a manner that they do not interfere with each other when mounted on the scaffold at the same ledger level. It is thus possible for instance to mount the fixing means of a first lift, along the side of the interface, on the two opposite ledgers adjacent to the ledger in the interface, and not to this ledger in the interface itself, while the fixing means of the second lift unit along the side of the interface can be mounted on the ledger in the interface. Arranged coupling structures can be used for this purpose along the side of the interface.

Discussed in the above description are examples of coupling structures 822 and 832 and fixing means 82 and 83. In further embodiments of the present invention blocking means (not shown) can further be comprised in the coupling structures which, after hooking of these coupling structures over the ledgers, additionally safeguard the fixing relative to the ledgers by further making a possible undesirable unhooking of the fixing means impossible.

In the description of determined embodiments according to the present invention different features are sometimes grouped in a single embodiment, figure or description thereof, with the purpose of contributing toward the understanding of one or more of the different inventive steps. This may not be interpreted as if all features of the group are necessarily present in order to solve a specific problem. Inventive aspects are not to be found in all features of such group features present in the description of a specific embodiment.

While some of the embodiments described herein comprise some, but not other, features included in other embodiments, combinations or features of different embodiments are intended to lie within the scope of the invention and to form different embodiments, as would be appreciated by the skilled person.

While the principles of the invention have been described above in respect of specific embodiments, it must be clearly understood that this description is given only by way of example and is not limitative for the scope of protection defined by the appended claims.

The invention claimed is:

1. A lift unit for ascending and descending in a shaft formed by a scaffold column, the scaffold column comprising at least one scaffold section, the at least one scaffold section being defined as comprising two sets of four ledgers which form equal rectangles which lie substantially in horizontal planes and which are connected to each other by means of uprights at their corresponding corners, the lift unit comprising a first part comprising a first set of means for removably coupling the first part to different heights of the scaffold column;

a second part comprising a second set of means for removably coupling the second part to different heights of the scaffold column; and means for varying a distance between the first part and the second part, wherein when only the first part is coupled at a height to the scaffold column, the means for varying the distance between the first part and the second part are configured to push the second part upward or lower the second part downward relative to the first part coupled to the scaffold column, and wherein when only the second part is coupled at a height to the scaffold column, the means for varying the distance between the first part and the second part are configured to pull the first part upward or lower the first part downward relative to the second part coupled to the scaffold column.

2. A lift unit as claimed in claim 1, which is further adapted during an ascending movement to fix the first set of means for removably coupling the first part to the scaffold column each time at the previous height of the second set of means for removably coupling the second part to the scaffold column.

3. A lift unit as claimed in claim 2, which is adapted during the ascending movement to cause the first set of means for removably coupling the first part to temporarily rise above the second set of means for removably coupling the second part before fixing the first set of means for removably coupling the first part to the scaffold column.

4. A lift unit as claimed in claim 1, wherein the different heights correspond to the ledger levels of the scaffold.

5. A lift unit as claimed in claim 1, wherein the means for varying a distance between the first part and the second part comprises a scissor lift.

6. A lift unit as claimed in claim 1, wherein the first set of means for removably coupling the first part and the second set of means for removably coupling the second part are adapted to be placed in a position which avoids obstacles when the distance between the first part and the second part is varied.

7. A lift unit as claimed in claim 6, wherein the obstacles comprise ledgers and uprights of the scaffold.

8. A lift unit as claimed in claim 1, wherein the first set of means for removably coupling the first part and the second set of means for removably coupling the second part are adapted so that they can be retracted or pivot away toward a central part of the scaffold column.

9. A lift unit as claimed in claim 1, wherein the first set of means for removably coupling the first part and the second set of means for removably coupling the second part are adapted to rotate away from a ledger within the scaffold column.

10. A lift unit as claimed in claim 1, wherein the first set of means for removably coupling the first part and the second set of means for removably coupling the second part are adapted to be placed in a position which allows them avoid each other during varying of the distance between the first part and the second part, wherein the first set of means for removably coupling the first part and the second set of means for removably coupling the second part move adjacently with respect to each other in a vertical direction.

11. A lift unit as claimed in claim 1, wherein the second part comprises a work-floor.

12. A lift unit as claimed in claim 1, wherein the first part or the second part comprises a base platform comprising a drive system for the means for varying a distance between the first part and the second part.

13. A lift unit as claimed in claim 12, wherein the base platform is comprised in the first part and a work-floor in the second part.

* * * * *